US006726426B2

(12) United States Patent
Spiel

(10) Patent No.: US 6,726,426 B2
(45) **Date of Patent: *Apr. 27, 2004**

(54) COMBINATION PLASTIC SPIRAL FORMING MACHINE AND SEMI-AUTOMATIC PLASTIC SPIRAL BINDING MACHINE

(76) Inventor: Norton Spiel, 181-40 Midland Pkwy., Jamaica, NY (US) 11432

( * ) Notice: Subject to any disclaimer, the term of this patent is extended or adjusted under 35 U.S.C. 154(b) by 0 days.

This patent is subject to a terminal disclaimer.

(21) Appl. No.: 10/215,656

(22) Filed: Aug. 10, 2002

(65) Prior Publication Data

US 2003/0035703 A1 Feb. 20, 2003

Related U.S. Application Data

(63) Continuation of application No. 09/677,489, filed on Oct. 2, 2000, now Pat. No. 6,547,502, which is a continuation-in-part of application No. 09/460,887, filed on Dec. 14, 1999, now Pat. No. 6,312,204, which is a continuation-in-part of application No. 09/100,724, filed on Jun. 19, 1998, now Pat. No. 6,000,896, which is a continuation-in-part of application No. 08/843,754, filed on Apr. 21, 1997, now Pat. No. 5,890,862.

(51) Int. Cl.[7] ..... B42B 5/10; B42B 5/12; B42B 9/00

(52) U.S. Cl. ..... 412/40; 412/38; 412/39; 425/289; 425/384; 425/391; 425/143; 425/160; 425/509; 140/92.3; 140/92.4; 264/157; 264/158; 264/280; 264/281; 29/564.6

(58) Field of Search ..... 412/40, 38, 39; 425/391, 289, 384, 143, 160, 509; 140/92.3, 92.4; 264/157, 159, 280, 281; 29/564.6

(56) References Cited

U.S. PATENT DOCUMENTS

| | | | | |
|---|---|---|---|---|
| 2,638,609 A | | 5/1953 | Penner | 11/1 |
| 3,101,750 A | | 8/1963 | Pfaffle | 140/92.3 |
| 3,121,256 A | * | 2/1964 | Fieisher | 425/391 |
| 3,378,045 A | | 4/1968 | Thurman | 140/92.94 |
| 3,520,334 A | | 7/1970 | Mueller | 140/92.93 |

(List continued on next page.)

FOREIGN PATENT DOCUMENTS

| | | | |
|---|---|---|---|
| DE | 1 944 223 | 8/1969 | B42C/1/06 |

OTHER PUBLICATIONS

PVC Spiral Supply Co., "Marlon 700", approximately 7 pages.

*Primary Examiner*—A. L. Wellington
*Assistant Examiner*—Mark T. Henderson
(74) *Attorney, Agent, or Firm*—Alfred M. Walker

(57) ABSTRACT

A combination book binding machine with a plastic coil forming machine, whereby a plastic spiral coil is formed at a first raised temperature, then cut to a length sufficient for the plastic spiral coil to bind a book, cooled and then advanced toward a receiving coil conveyor of a coil binding machine, for binding the book with a plastic coil at the lowered cooled temperature. The binding machine and method for spirally binding a sheaf of papers into a book uses an adjustable speed drive to rotate the cooled flexible plastic spiral coil into respective holes in the book. The book has a plurality of holes in a row adjacent one edge of the book to receive the leading edge of the plastic spiral binding coils. A cylindrically shaped mandrel is spaced apart from a glidable block. The plastic pre-formed spiral binding coil is fed onto the mandrel from the distal end thereof, with the leading edge of the binding element facing and spaced apart from the book. A pair of leading edge spreaders, one of which has a guidance groove, engages the plastic spiral coil to spread its joined coil portions just enough to permit the coil to enter the successive holes of a sheaf to be bound. A trailing spreader at the opposite end insures that the last hole is accommodated with a portion of the plastic spiral coil.

7 Claims, 19 Drawing Sheets

U.S. PATENT DOCUMENTS

| | | | | | |
|---|---|---|---|---|---|
| 3,826,290 | A | | 7/1974 | Pfaffle | 140/92.7 |
| 3,839,759 | A | | 10/1974 | Staats | 11/1 A |
| 3,866,254 | A | | 2/1975 | Gronda | 11/1 AC |
| 3,922,109 | A | | 11/1975 | Hagen | 416/213 |
| 3,924,664 | A | | 12/1975 | Pfaffle | 140/92.7 |
| 3,967,336 | A | | 7/1976 | Cutter | 11/1 AC |
| 4,008,501 | A | | 2/1977 | Cutter | 11/1 AC |
| 4,074,958 | A | * | 2/1978 | Molenaar | 425/71 |
| 4,120,929 | A | * | 10/1978 | Reum | 264/210.2 |
| 4,129,156 | A | | 12/1978 | Pfaffle | 140/92.4 |
| 4,137,289 | A | | 1/1979 | Staats | 264/138 |
| 4,143,686 | A | | 3/1979 | Sickinger et al. | 140/92.93 |
| 4,157,821 | A | | 6/1979 | Fabrig | 270/58.07 |
| 4,161,196 | A | | 7/1979 | Fabrig | 140/92.4 |
| 4,165,766 | A | | 8/1979 | Fabrig | 140/92.7 |
| 4,178,972 | A | | 12/1979 | Pfaffle | 140/105 |
| 4,182,738 | A | * | 1/1980 | Casaert | 264/210.2 |
| 4,185,668 | A | | 1/1980 | Harbert | 140/92.4 |
| 4,208,750 | A | | 6/1980 | Pfaffle | 11/1 A |
| 4,232,858 | A | | 11/1980 | Fabrig | 270/53 |
| 4,237,568 | A | | 12/1980 | Kunzmann | |
| RE30,491 | E | | 1/1981 | Gomez | 11/1 A |
| 4,249,278 | A | | 2/1981 | Pfaffle | 11/1 A |
| 4,267,865 | A | | 5/1981 | Negro | 140/92.94 |
| 4,327,780 | A | | 5/1982 | Lehmann | 140/92.7 |
| 4,349,490 | A | * | 9/1982 | Bos | 264/566 |
| 4,351,371 | A | | 9/1982 | Mann et al. | 140/92.3 |
| 4,367,815 | A | | 1/1983 | Fabrig | 198/374 |
| 4,369,015 | A | | 1/1983 | Fabrig | 414/31 |
| 4,373,558 | A | | 2/1983 | Dawson | 140/71 R |
| 4,378,822 | A | | 4/1983 | Morris | 140/92.3 |
| 4,388,264 | A | * | 6/1983 | Leuvelink | 264/281 |
| 4,425,773 | A | | 1/1984 | Fabrig | 72/142 |
| 4,426,871 | A | | 1/1984 | Fabrig | 72/141 |
| 4,501,304 | A | | 2/1985 | Lehmann | 140/103 |
| 4,525,117 | A | | 6/1985 | Jones | 412/39 |
| 4,540,360 | A | * | 9/1985 | Leo | 425/384 |
| 4,545,603 | A | | 10/1985 | Henes et al. | 281/21 A |
| 4,721,136 | A | | 1/1988 | Negro | 140/71 R |
| 4,729,708 | A | | 3/1988 | Fabrig | 412/1 |
| 4,811,973 | A | | 3/1989 | Kumar-Misir | 281/21 A |
| 4,833,980 | A | | 5/1989 | Bringhurst | 101/93.04 |
| 4,886,259 | A | | 12/1989 | Ishikawa | 270/53 |
| 5,036,690 | A | | 8/1991 | McGowen | 72/49 |
| 5,061,338 | A | * | 10/1991 | Huvey | 156/425 |
| 5,407,232 | A | | 4/1995 | Des Jarlais | 281/16 |
| 5,417,508 | A | | 5/1995 | Friedman | 402/19 |
| D365,580 | S | | 12/1995 | Stiles | D15/128 |
| 5,497,811 | A | | 3/1996 | Pigna | 140/71 R |
| 6,042,320 | A | * | 3/2000 | McHenry et al. | 412/39 |
| 6,190,156 | B1 | * | 2/2001 | Primeau et al. | 425/391 |
| 6,382,950 | B1 | * | 5/2002 | DesJarlais et al. | 425/193 |
| 6,547,502 | B1 | * | 4/2003 | Spiel | 412/40 |

* cited by examiner

Fig. 10
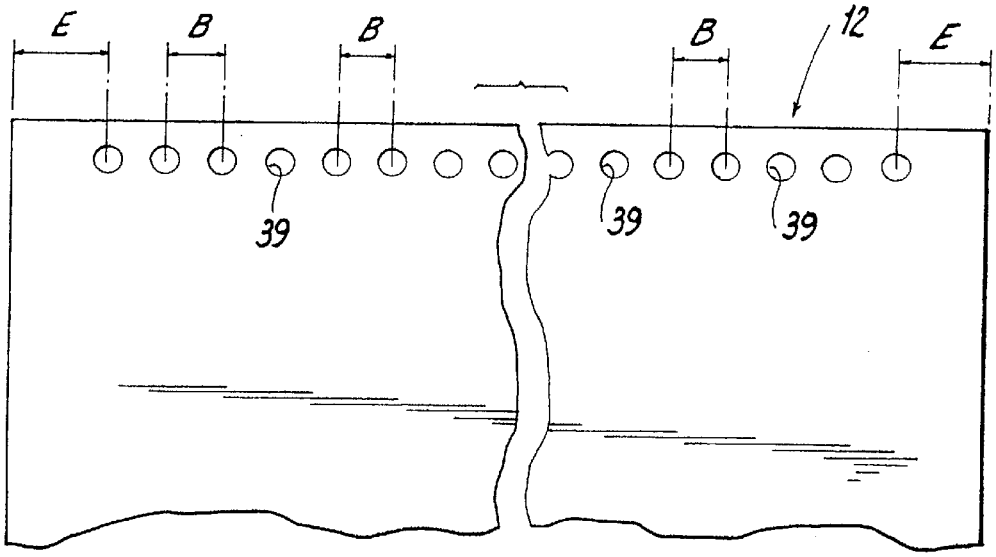
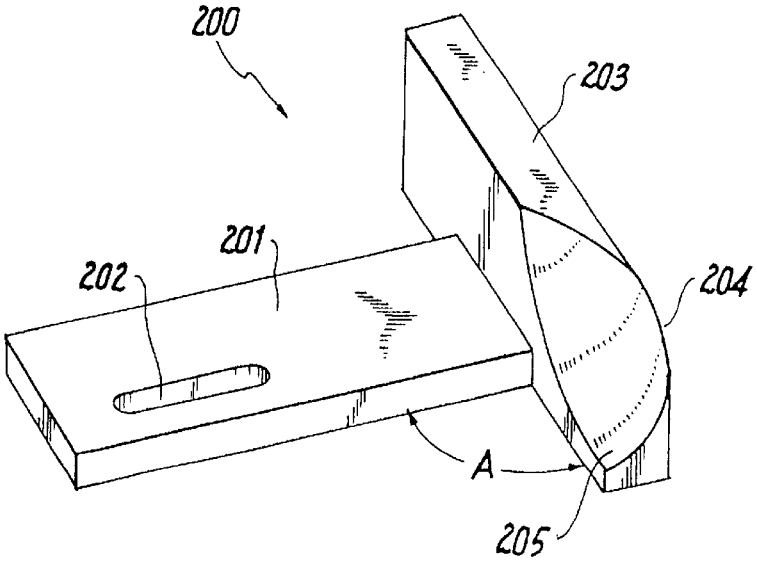
Fig. 11

Fig. 15
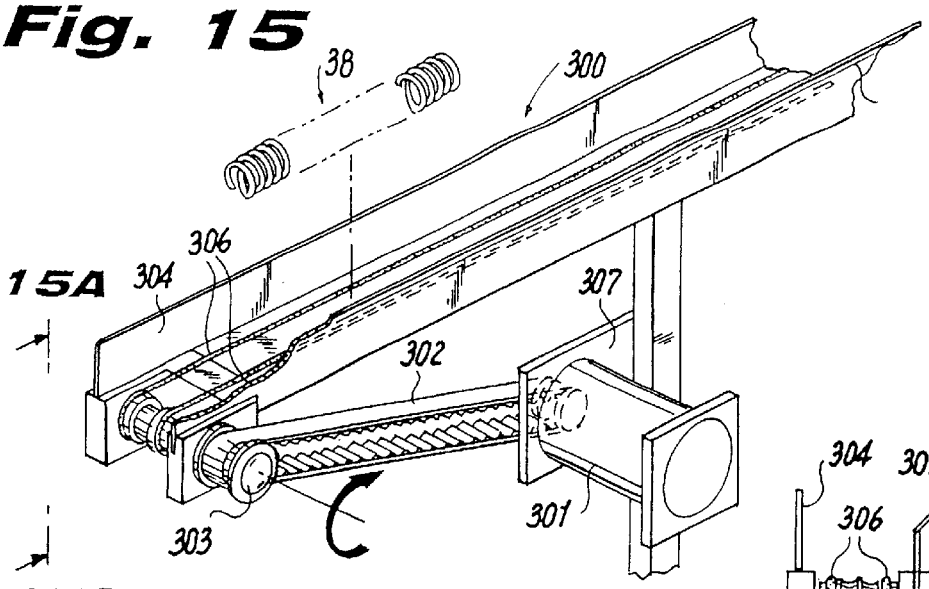
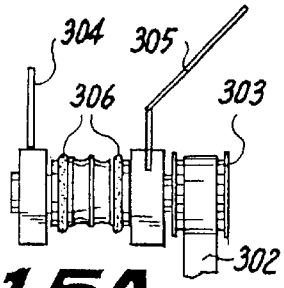
Fig. 15A
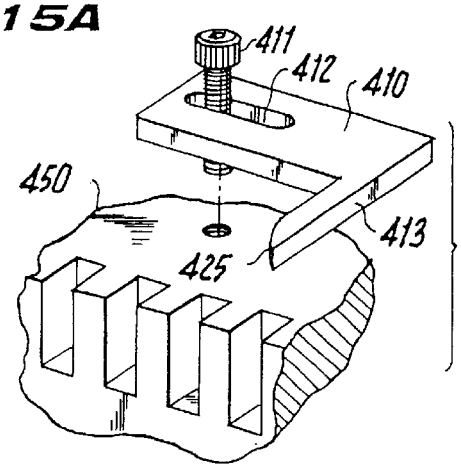
Fig. 16
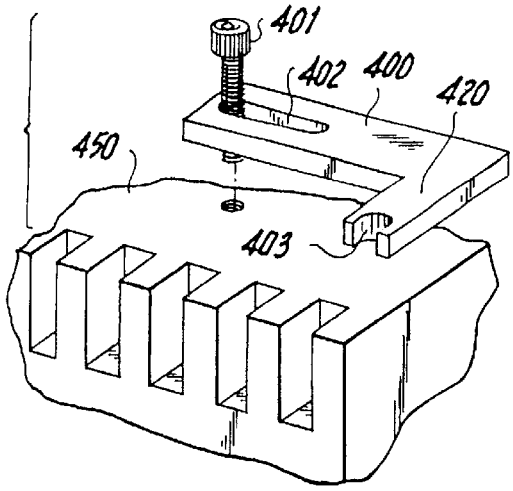
Fig. 17
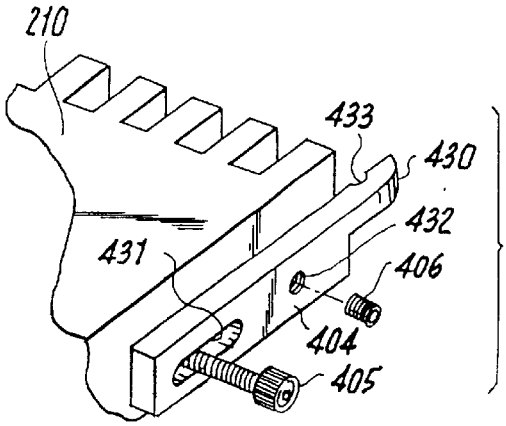
Fig. 18

COMBINATION PLASTIC SPIRAL FORMING MACHINE AND SEMI-AUTOMATIC PLASTIC SPIRAL BINDING MACHINE

RELATED APPLICATIONS

This application is a continuation of application Ser. No. 09/677,489 filed Oct. 2, 2000 now U.S. Pat. No. 6,547,502 which is a continuation-in-part of my application Ser. No. 09/460,887 filed Dec. 14, 1999, now U.S. Pat. No. 6,312,204 which application is a continuation-in-part of my application Ser. No. 09/100,724, filed Jun. 19, 1998, now U.S. Pat. No. 6,000,896 dated Dec. 14, 1999, which application was a continuation-in-part of application Ser. No. 08/843,754 filed Apr. 21, 1997, now U.S. Pat. No. 5,890,862 dated Apr. 6, 1999.

This application incorporates by reference the subject matter contained therein.

FIELD OF THE INVENTION

This invention relates to a combination book binding machine with a plastic coil forming machine, whereby a plastic spiral coil is formed at a first raised temperature, then cut to a length sufficient for the plastic coil to bind a book, cooled and then advanced toward a receiving coil conveyor of a coil binding machine, for binding the book with a plastic coil formed at the lowered cooled temperature.

BACKGROUND OF THE INVENTION

While most of the prior art in the field of spiral binding apparatus relates to the use of metallic wire spirals, two patents specifically relate to the use of plastic spirals. U.S. Pat. No. 2,638,609 of Penner describes a machine for binding books with special features for aligning the perforations of a sheaf of papers to be bound and to confine the travel of the plastic spiral binding material. U.S. Pat. No. 4,249,278 of Pfaffle describes a machine for spiral binding which feeds plastic thread from a bulk spool, softens the thread, winds it on a mandrel to form a spiral, cools it to harden and then feeds the rigid spiral into a perforated sheet group.

Pfaffle '278 integrates the process of the forming of plastic spiral binding coils from plastic thread with that of a binding machine to produce an end product of spiral bound books. Plastic thread is pulled from a spool, preheated, wound around a mandrel in a heated zone, continuously fed into a cooling sleeve for rapid cooling by exposure to a blast of cold air generated by a vortex cooler and then the spiral is fed into the binding machine. However, in Pfaffle '278 the plastic coil material of polyvinyl-chloride (PVC) can become brittle by the rapid cooling, since it develops voids in its interior. The resulting spiral coil is too brittle to process in a book binding machine since the ends are broken off during the bending process or in early use of the bound books by the ultimate consumer.

Other patents relating to spiral binding machines include U.S. Pat. No. 4,378,822 of Morris which describes a spiral binding machine with a drive component. However, the mandrel of Morris '822 is fixed, not laterally adjustable as in the present invention, and the mandrel of Morris '822 has a closed end, which requires pre-feeding of the spiral thereon.

OBJECTS OF THE INVENTION

It is an object of this invention to provide a combination plastic spiral coil forming machine that can also accurately insert the plastic spiral coils into a book for binding.

It is yet another object of this invention to provide a spiral bound book with a durable, non-brittle plastic spiral coil.

It further an object of the present invention to provide a transfer conveyor which advances hot, recently formed plastic spiral coils from a forming machine to a spiral insertion machine while cooling the plastic spiral coils.

It is yet another object of this invention to provide an advancement means for accurately transporting a formed plastic spiral coil to its proper position for insertion into the first spiral insertion hole of the book.

It is another object of this invention to be able to quickly cool a formed plastic spiral coil into a solid, flexible state for insertion into spiral insertion holes of a book.

It is another object of this invention to provide a semi-automatic machine of low cost and reliable operation.

It is yet another object of this invention to improve over the disadvantages of the prior art.

SUMMARY OF THE INVENTION

In keeping with the objects of the present invention and others which may become apparent, the present invention provides a process for binding books which includes the steps of forming a plastic coil using a plastic spiral forming machine, cooling the plastic coil and inserting the cooled, formed plastic coil into a spiral bindery machine that inserts the cooled, formed coil to bind a book.

After the plastic coil is formed, it is cut and advanced upon a conveyor belt having a plurality of compartments, each holding formed plastic coils. Each of these coils are separately ejected onto each respective compartment, of the plurality of compartments located on the conveyor belt, which is sequentially advanced to expose another compartment of the plurality of compartments on the conveyor belt for the next, formed coil.

While other methods of cooling may be applied to the hot, formed plastic coils, the coils may be cooled by being advanced on the conveyor at a speed sufficient for the temperature of the plastic coil to lower. The advancement of each cooled plastic coil is toward a receiving coil conveyor of the coil binding machine. Then the book is bound with insertion of the lowered temperature plastic coil into the series of edge holes in the book.

While other configurations for the coil advancing conveyor may be used, preferably the linkage conveyor which conveys the plastic coils is a wide belt supported by a stationary horizontal platen, wherein the wide belt has a rigid chain construction with a plurality of fins attached thereto.

A drive pulley communicates with and advances the wide belt and the plurality of fins form the group of separate compartments, which allow the placement of plastic coils therein. For power, a gear motor is electrically connected to a drive pulley. In addition, a motor speed controller is electrically connected to a gear motor, so that the motor speed controller causes the drive pulley to intermittently rotate, thereby intermittently advancing each plastic coil on the belt towards the coil binding machine.

The basic operational concept of the coil insertion portion of the present invention is to use an adjustable speed drive to rotate a spiral coil for a spiral bound book at optimum speed for the diameter of a particular spiral as well as the thickness of the book being bound. This, along with a smooth mandrel with a spiral stabilizing spring, controls the proper feeding of the spiral without the necessity for expensive machined parts to confine the spiral to prevent its distortion.

After the cooled plastic coil is advanced upon the conveyor, the binding machine portion of the present invention spirally binds a sheaf of papers into a book. It clamps together the sheaf of papers making up the book, which book has a plurality of holes in a row adjacent to one edge of the book, to receive the leading edge of the spiral binding element. The machine includes a stationary base which is from one end of the book, and a block slidably mounted on the base, which has an arm extending outwardly.

The arm supports at its distal end thereof a cylindrically shaped mandrel, which is spaced from the slidable block and the bottom edge of the mandrel horizontally in a line corresponding with the row of holes in the book. The arm is attached at its distal end to the mandrel at the proximate end of the mandrel, which faces the row of holes and is spaced apart from the book. The arm is attached to the block at the proximate end, to adjust the distance between the mandrel and the block.

After being advanced on the cooling conveyor, a feeding mechanism feeds the cooled plastic, pre-formed, spiral binding coil element onto the mandrel, from the distal end thereof, which spiral binding element terminates at the proximate end of the mandrel. The leading edge of the binding element faces, and is spaced apart from the book. The internal diameter of the spiral binding element is slightly in excess in size of the outer diameter of the mandrel.

A spring is mounted on the slidable block to engage and to adjustably bias the cooled spiral binding coil on the mandrel upwardly, against the mandrel, so that the upper portion of the binding element is spaced apart from the top of the mandrel.

A wheel, having an outer frictional surface, engages a top outer surface of the cooled spiral binding coil and a motor drives the wheel, to feed the cooled spiral binding coil into the row of holes in the book, for binding the book.

An adjusting mechanism adjusts the position of the block on the base, positioning the mandrel, to obtain proper alignment of the leading edge of the spiral binding element with the row of holes of the book.

To prevent ripping at the edge of the book after it is bound and used, the breach on the book's cover from the edge of the book to the first spiral coil insertion hole of the book is maximized. This is accomplished by a spreader which increases the breach between adjacent coil segments to align with the predetermined breach from the boundary of the book to the first hole, so that the plastic spiral coil can be accurately inserted into the first spiral insertion hole of the book, and thereafter into the other holes for the book.

For example, while sizes of holes in the book may vary, the holes are typically 11/64 inch in diameter, and the measured space between the mid point of each hole to the next adjacent midpoint of the next adjacent hole is about ¼ inch. Consequently the space between adjacent holes is equal to 5/64 inch, which is measured as the distance of ¼ (or 16/64) inch from hole mid point to hole midpoint, taking into account and deducting the 11/64 diameter of each hole.

In the prior art the breach between the first hole and the leading boundary of the pages of the book has also been only about 5/64 inch, which is too small a breach to prevent damage by ripping of the cover at the boundary down to the first hole. In the present invention, the breach is increased to about 3/16 inch, which is more than double the length of the typical breach on the leading edge of a spiral bound book.

However, to increase the leading edge gap, the distance between adjacent coil segments of a plastic spiral coil must be increased from the typical 5/64 inch length to 3/16 inch.

This increase in distance is accomplished by a spreader mechanism which contacts and spreads apart the coils of the spiral as they advances from an alignment mandrel to the position where the spiral is enclosed into the leading hole of the book to be bound. The spreader moves apart the first adjacent coil segments from their hole engaging distance of 5/64 inch to the increased distance of 3/16 inch.

The spreader device has a pair of leading edge spreaders located where the leading boundary edge of the book to be bound is held in place between a pair of comb jaw clamps. Two spreaders are used at the leading edge and a single spreader is used at the trailing edge of the book.

The leading spreader has a body with a slot therein for increasing or decreasing the position of the spreader with respect to the edge of the book to be bound with the plastic spiral.

This leading spreader is preferably a one piece metal unit with an arcuate convex edge being provided at the recess to engage and spread apart adjacent segments of the spiral coil as it advances over the breach between the leading boundary edge of the book and the first hole of the book, toward the first leading hole of the book to be bound.

This first spreader is mounted to a combed clamp jaw permanently attached to, or integral with, a top shelf of the spiral binding machine.

A second spreader, namely a side guide spreader, is mounted to an outer pivotal combed clamp jaw, which pivots into position for tightening the book between the two combed clamp jaws.

A trailing spreader guide is provided at the trailing end of the book to spread apart arcuate segments of the spiral coil as it exits the last edge hole at the trailing distal end of the book being bound. The trailing guide spreader is beveled with a contoured end to engage the coils of the spiral as it engages the last trailing hole of the book.

The side guide spreader adjacent to the leading spreader is a single metal piece with an anvil-type blade extending in the direction of the leading spreader. The front of the blade is fixed to a curved pointed edge which is also rounded to engage the spiral without damage. A spiral guidance groove is located on the back edge of the blade of the spreader side guide to engage a single coil of the spiral.

The front leading spreaders combine to spread a single coil of the spiral as it goes into the first edge hole. Guide notches of the combed clamp jaws are utilized at the path of plastic spiral as it moves through the holes in the book being bound. These notches also align with the holes of the book.

After the cooled, formed plastic spiral coil is advanced on the linkage cooling conveyor, a second conveyor at the beginning of the book binding machine portion moves the plastic spiral to the mandrel for its proper position for insertion into the first spiral insertion hole of the book. The second conveyor includes upwardly extending side guide walls which attenuate on either side of the conveyor. A conveyor motor powers the second conveyor belt about a pulley. In a preferred embodiment, the second conveyor belt may be a pair of elastic cables placed parallel to one another, wherein the spiral touches the cables along the edges of the coil surfaces thereof.

The binding machine also optionally has a cutter for cutting. The plastic spiral binding coil is wound on the book at both ends of the book, and bends both ends of the plastic spiral binding coil element on the book.

Preferably, the binding machine portion of the present invention includes a sensor, such as an optical sensor, for signaling that the leading edge of the spiral binding element has been reached.

A positioning mechanism, such as a pneumatically driven mechanism, positions a rotatable wheel for contact with the spiral binding coil. It includes a hydraulic shock absorber for mediating the speed of engagement of the wheel with the spiral binding coil.

Furthermore, optionally the cutter includes a pair of separated cutting members which are spaced apart from each other, and a rotatable arm for engaging the two cutting members and for actuating the cutting and bending action when rotated in one direction. A further member moves the rotatable arm in a second direction.

A control panel is provided for sequencing the steps of binding the book and indicating visually when the cutting and bending of ends is completed, so that the binding action can be repeated for the next subsequent book to be spirally bound.

BRIEF DESCRIPTION OF THE DRAWINGS

The present invention can best be understood in connection with the accompanying drawings, in which:

FIGS. 5A and 5B are front views of a cutter, wherein:

FIG. 5A is a view in a raised position;

FIG. 5B is a view in a lowered cutting position;

FIG. 10 is a front top detail view of a book hole pattern;

FIG. 11 is an isometric view of coil spreader;

FIG. 15 is an isometric back view detail of the conveyor subsystem as in FIG. 14;

FIG. 15A is an end view detail of the conveyor thereof;

FIG. 16 is an isometric view of a trailing spreader of a further alternate embodiment for a spreader sub-system;

FIG. 17 is an isometric view of the top mounted part of the leading spreader used in conjunction with the alternate embodiment shown in FIG. 16;

FIG. 18 is an isometric view of the side mounted part of the leading spreader of the alternate embodiment of FIGS. 16 and 17;

DETAILED DESCRIPTION OF THE DRAWINGS

Figure 1:
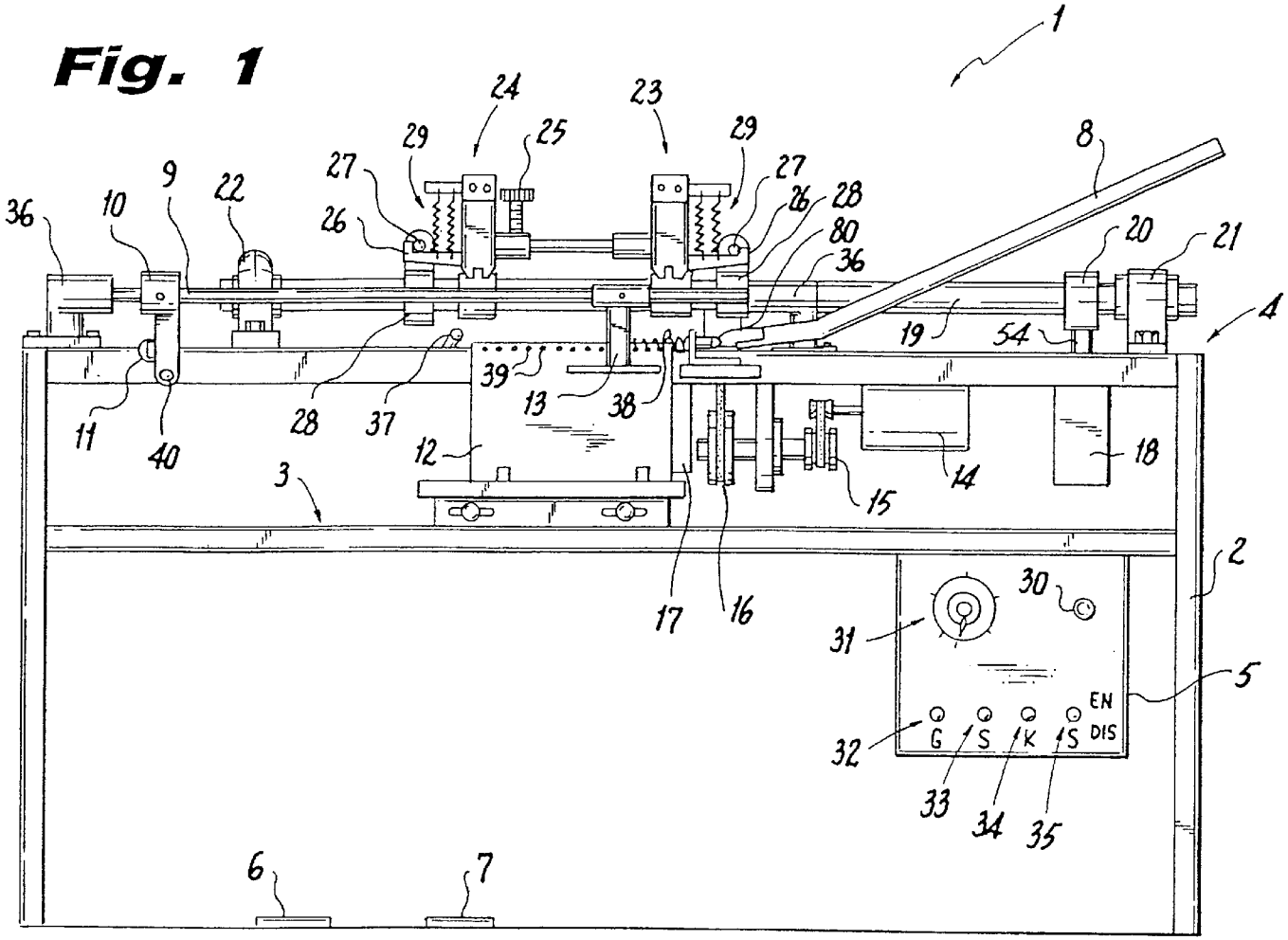
FIG. 1 is a front view of the binding machine portion of the combination plastic coil forming and binding machine of the present invention.

FIG. 1 shows a front view of the semi-automatic plastic spiral binding machine 1 portion of the combination coil forming and binding system of the present invention. A frame 2 supports a lower shelf 3 and a top shelf 4 which is a mounting platform for most of the apparatus. A control panel 5 shows a spinner speed control 31, a main on/off switch 30 and four other switches which have enable/disable positions. These switches are used to isolate several machine subsystems during diagnostic testing or preventative maintenance. They are the gate switch 32, the spinner engage switch 33, the knife switch 34 and the sensor switch 35. Except for the spiral spinner which is driven by an electric motor 14, all of the other moving elements of the machine 1 are pneumatically driven. This is a cost-effective and reliable design feature.

Figure 2:
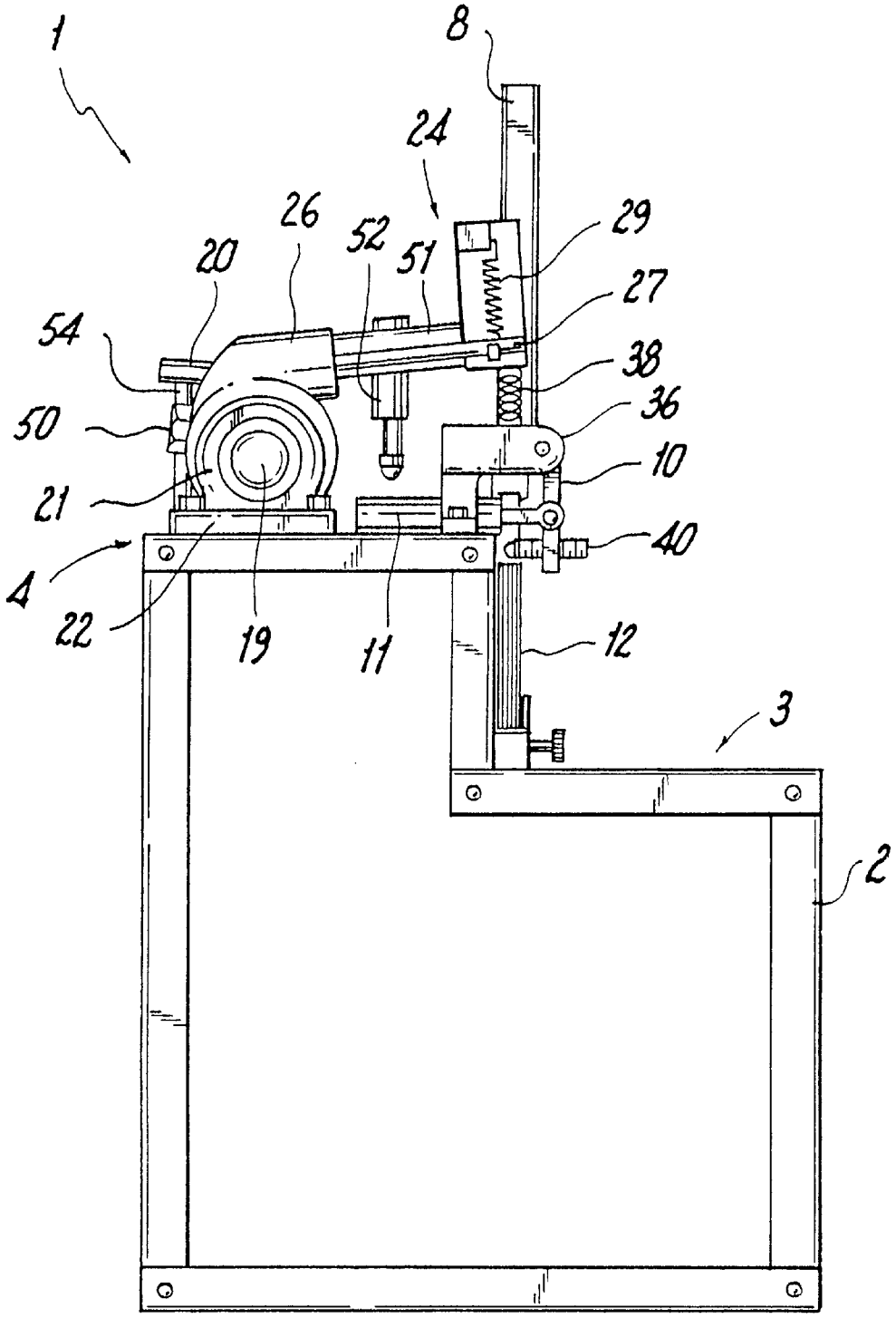
FIG. 2 is a side view of one embodiment for the binding machine.

Some of the machine elements may be more visible in the side view of FIG. 2. A main shaft 19 is carried in bearing blocks 22 and 21; it rotates only a about 30 degrees in operation and is driven by pneumatic cylinder 18 through piston rod 51 acting on offset arm 20 which is fastened to main shaft 19. Shaft 19 is used to actuate both cutters 23 and 24 through drive bars 27 attached to shaft collars 26. Each of the cutters 23 and 24 pivots on an arm 51 which rotates freely on shaft 19. This arm is spring biased through adjustable stop 52 to be at its uppermost position until urged downward by the action of bar 27.

Dual springs 29 resist the motion of bar 27 thereby moving the entire cutter 23 or 24 downward into engagement with the spiral 38 end to be cut; this coincides with the stop adjustment of 52. At this point, further downward movement of the end of bar 27 moves arm 26 which actuates the cutter/bender element (not shown) within cutters 23 and 24. A sensor switch 108 (not shown in these views) detects that the cutting action has been accomplished. Cutter 23 is fixed laterally to coincide with the rightmost edge of book 12; cutter 24 has a lateral adjustment 25 which adjusts it to the left edge of book 12.

A book 12 to be bound is shown clamped by clamp element 13 attached to clamp shaft 9 which is retained in bearing blocks 36. The clamping action is supplied by pneumatic cylinder 11 acting on arm 10. Adjustable stop screw 40 adjusts the clamping to the thickness of book 12 and also actuates a "gate down" sensor switch 105 (not shown in these views). The book 12 is supported by adjustable book holder 17.

Book 12 has holes 39 which will accept plastic spiral wire 38 as it emerges from the mandrel 80 which is barely visible in FIG. 1 at the left end of spiral chute 8. The spiral wire 38 is spun by a dc gear motor 14 which drives a jackshaft through a timing belt and pulley arrangement 15. The final spinner drive is via belt 16. An optical detector 37 detects the end of the spiral wire 38 as it emerges from the left edge of book 12.

Figure 2A:
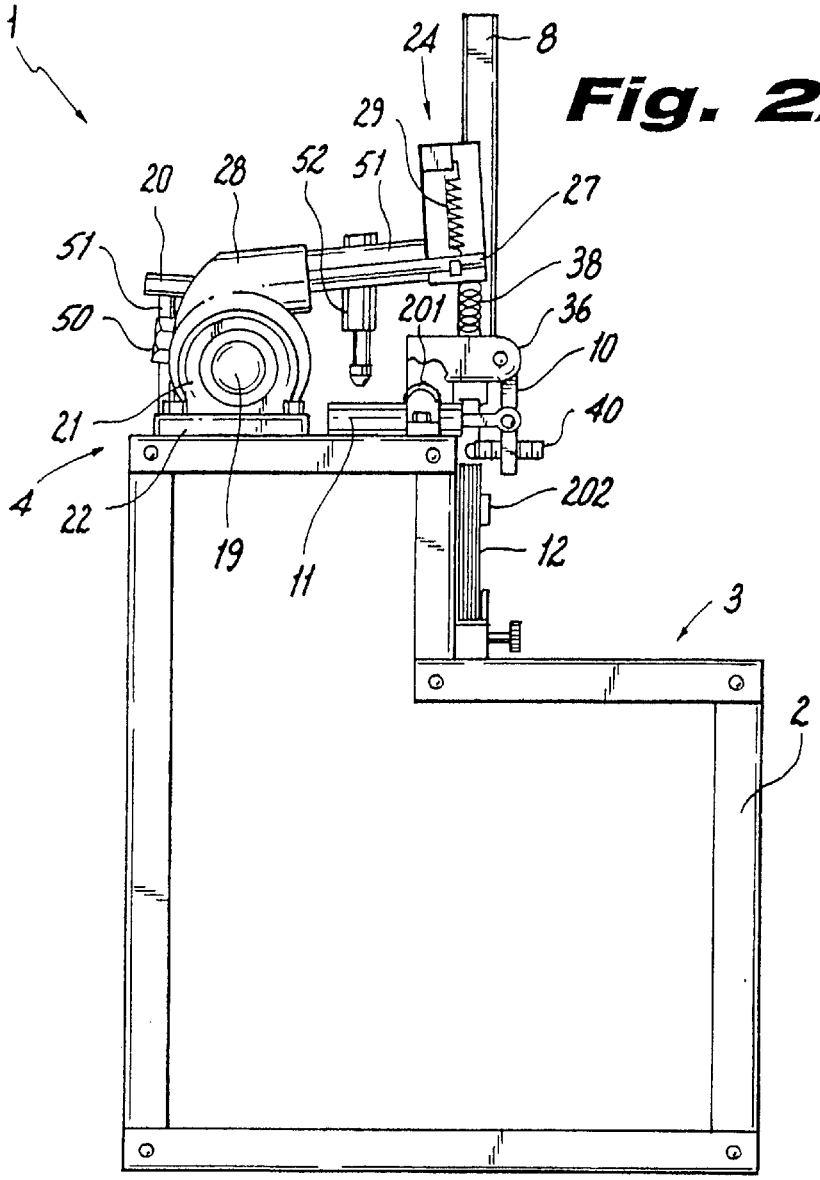
FIG. 2A is a side view of an alternate preferred embodiment of the binding machine.
Figure 2B:
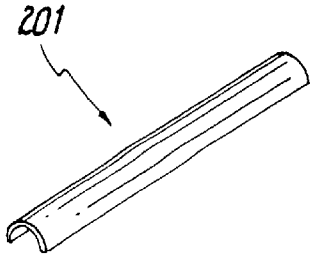
FIG. 2B is a close up perspective view of the coil stop portion of the binding machine as in FIG. 2A.
Figure 2C:
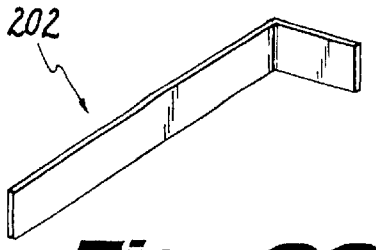
FIG. 2C is a close up perspective view of an L-shaped book stop to regulate pitch angle of the book spiral.

In the preferred embodiment shown in FIGS. 2A and 2B, half cylindrical stop member 201 extends longitudinally adjacent to spiral wire 38 to restrict lateral movement thereof. Moreover, in the preferred embodiment of FIG. 2C, L-shaped angled book stop 202 maintains pitch angle of the perforation holes 39 which accept spiral wire 38.

Figure 3:
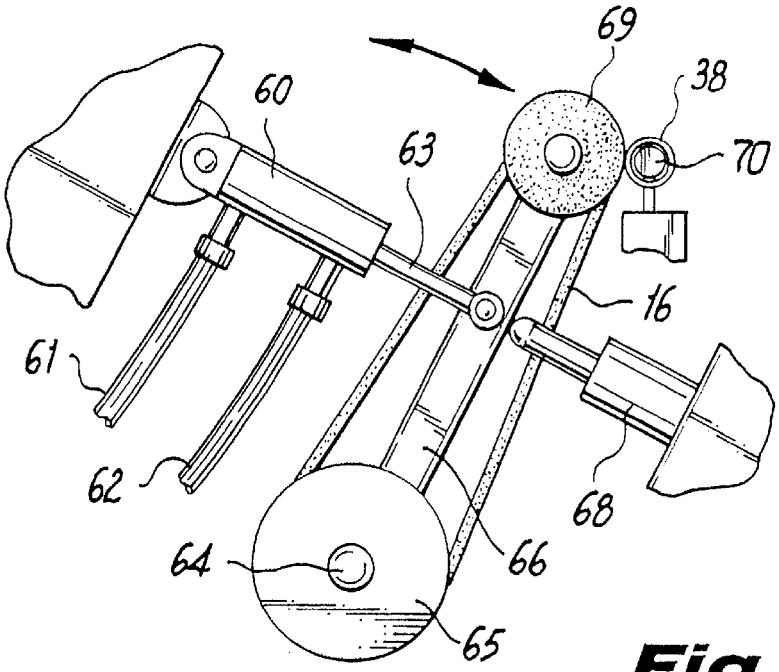
FIG. 3 is an end view of spiral drive mechanism.

FIG. 3 is a simplified end view of the engagement and drive system of the spiral spinner.

Figure 4:
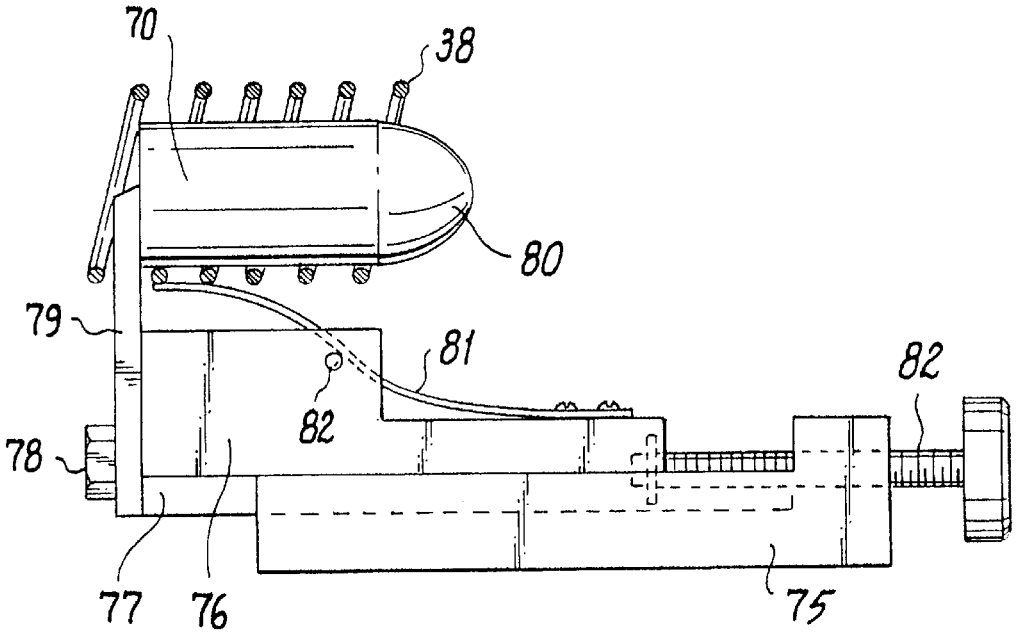
FIG. 4 is a front view close-up of the mandrel.

FIG. 4 is a front view of the mandrel 70 fixture with the spiral shown in crossection for clarity. The mandrel 70 has a bullet shaped nose 80 over with spiral wire 38 is fed from chute 8. An upright 79 which fits between the spiral wire 38 coils attaches mandrel 70 to block 76 by bolt 78. Block 76 is slidably attached to base 75 through dovetail slide 77 and a vernier adjustable in a lateral direction via vernier screw 82. A stabilizing leaf spring 81 gently presses the coils of spiral wire 38 against mandrel 70. The force can be adjusted by laterally sliding spring 81 over pin 82 and then tightening the retaining screws (not shown).

FIG. 3 shows an end view of spiral wire 38 around mandrel 70 with a wheel, such as fabric covered foam rubber wheel 69, pressing against it to rotate it. Alternatively, a wheel with a soft rubber tire can be used. The wheel 69 is urged against the spiral wire 38 or withdrawn from it by pneumatic cylinder 60 with extend port 61 and retract port 62. The speed of engagement is mediated by hydraulic shock absorber or snubber 68 which is always in contact with arm 66 which pivots concentrically on shaft 64. Pulley 65 and belt 16 drive wheel 69 by an upper pulley (not shown).

Figure 4A:
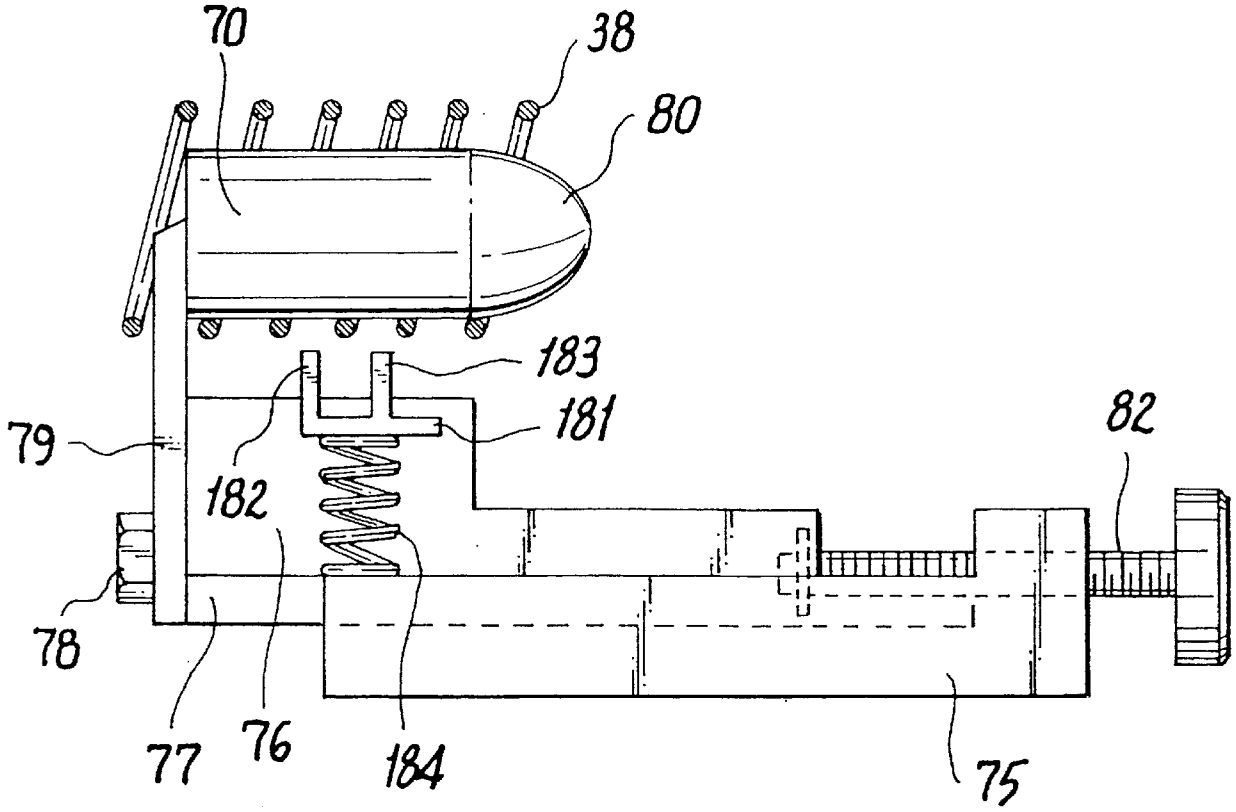
FIG. 4A is a front elevational view of a preferred embodiment for the mandrel holding spring member.

In the preferred embodiment shown in FIG. 4A, coil stop member 181 includes projections 182 and 183, to engage between adjacent coils of spiral wire 38, to hold spiral wire 38 in place. Upward tension against coil stop member 181 is provided by coil spring 184.

Figure 5A:
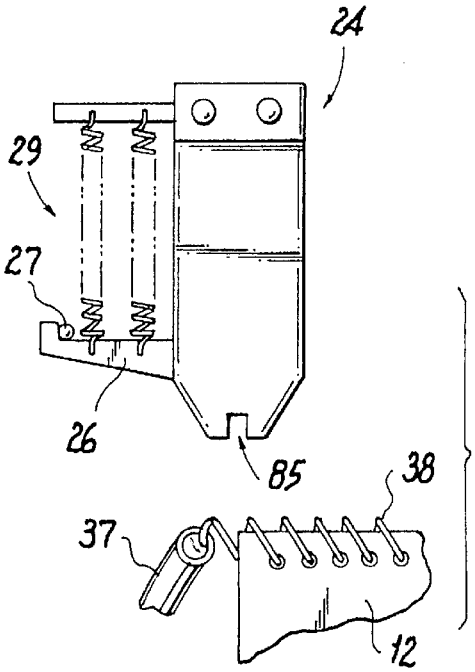
Figure 5B:
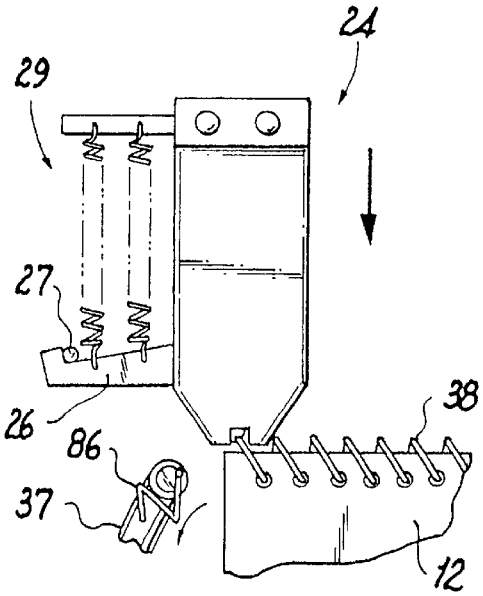

FIG. 5 shows the geometric relation of cutter 24 in its raised position at "A" and in its cutting position at "B" with cut spiral end 86 falling away. The position of optical sensor 37 relates to the emerging spiral wire 38 and the left edge of book 12. Being mounted via an adjustable armored cable it can easily accommodate a variety of book 12 widths.

Figure 6:
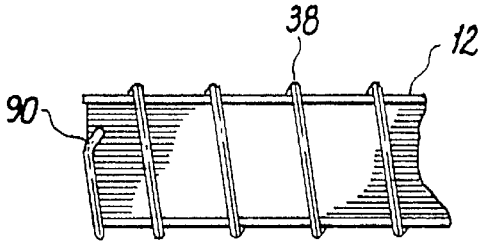
FIG. 6 is a top view of a cut and bent spiral end.

FIG. 6 is a top view detail showing the cut bent end of the spiral wire 38 after the cutting process. The cutters 23 and 24 are similar in operation to those commonly used for cutting and bending wire spirals.

The setup of the machine includes the following steps for customizing the subassemblies to match the particular book 12 size and spiral wire 38. The properly sized mandrel 70 is fitted and adjusted laterally by vernier screw 82 to guide spiral 38 to engage the book 12 perforations 39. The proper spinner speed is selected via control 31. The optical sensor is precisely positioned at the left edge of book 12. This may include one or more test runs.

The operation of the machine in the preferred embodiment is as follows:

Book 12 is placed in previously adjusted holder 17;

Right pedal 7 is pressed once to close clamp 13;

Spiral 38 is loaded in chute 8 and its end is positioned around mandrel 70;

Right pedal 7 is pressed one more time to initiate the automatic sequence. After spiral machine stops its sequence, left pedal 6 is pressed once to open clamp 13; and, Bound book 12 with spiral wire 38 therein is removed.

Although many design variations are possible without deviating from the spirit of the invention, the preferred embodiment is electropneumatic in design with no custom electronics or computer control. In this manner, it can be easily maintained by an electromechanical technician with no electronic or computer training. The preferred embodiment uses AC solenoid valves and relays. In alternate embodiments, low voltage DC solenoid valves, solid-state relays and/or microprocessor controls could be used to perform equivalent control tasks.

Figure 7:
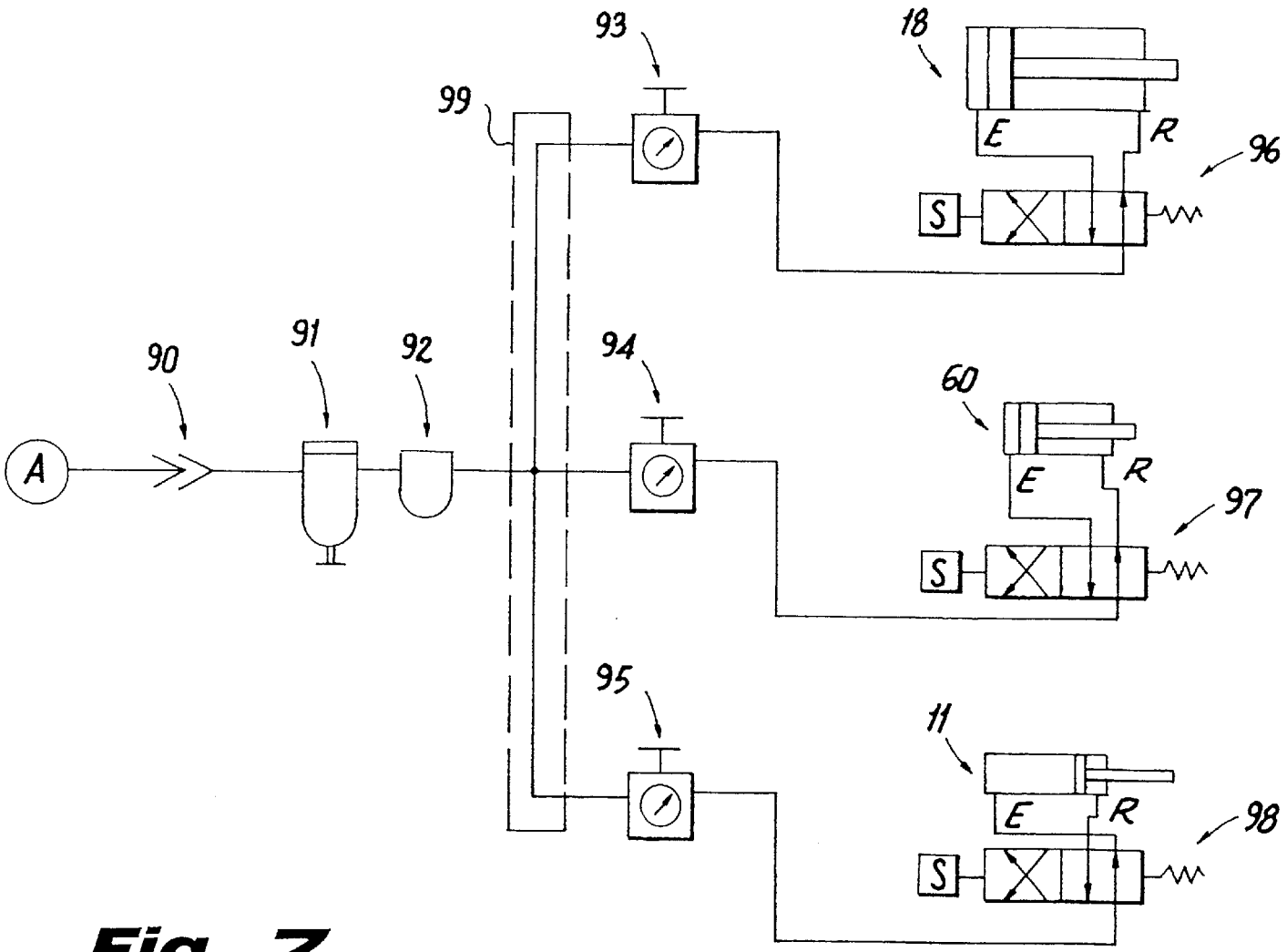
FIG. 7 is a pneumatic schematic diagram.

FIG. 7 shows a pneumatic system schematic. Shop air at 70 to 100 psig is supplied by a hose at A and coupled to the machine via "quick disconnect" 90. A filter/dryer 91 filters contaminants from the compressed air supply and removes moisture.

Next a lubricator 92 adds a small amount of oil to extend the life of the cylinders and valves. A manifold 99 distributes the filtered and lubricated air to three individual pressure regulators with integral indicators 93, 94 and 95. In this manner the pressure to the individual cylinders can be adjusted to select the optimum force for the particular task. Regulator 93 feeds solenoid valve 96 which controls cutter cylinder 18. Similarly, regulator 94 feeds solenoid valve 97 which controls spinner engagement cylinder 60. Finally, regulator 95 feeds solenoid valve 98 which controls the gate actuator cylinder 11. All solenoid valves are of the two port reversing two position type which extend or retract the two port double acting cylinders. The unenergized position of solenoid valves 96 and 97 keep their respective cylinders retracted by supplying pressure to the retract port while venting the extend port. Solenoid valve 98 keeps cylinder 11 extended in its unenergized position to keep the gate open by supplying pressure to the extend port while venting the retract port.

Figure 8:
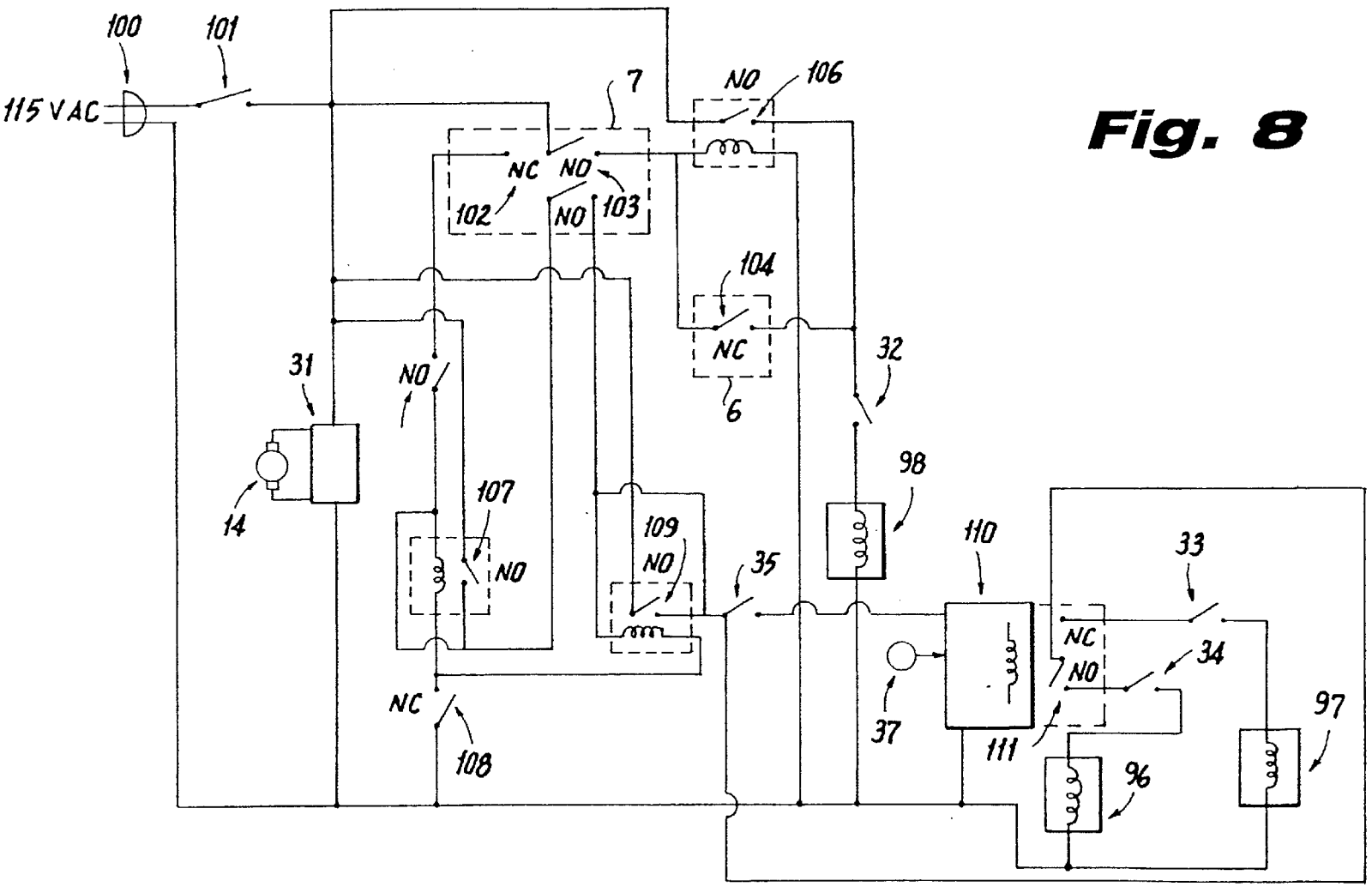
FIG. 8 is one embodiment for an electrical schematic diagram.

FIG. 8 is an electrical schematic of one embodiment. Right pedal 7 has two switches, a single-pole double-throw switch 102 and a single-pole single-throw (SPST) switch 103. The left pedal 6 has an SPST switch 104. Plug 100 supplies 115 VAC through main switch 101. Motor controller 31 drives spinner motor 14 continuously as long as 101 is on. By pressing the right pedal 7 once, relay 106 is energized closing its normally open contacts; it is latched on via feedback through normally closed switch 104. Switches 32, 33, 34 & 35 are simply enable/disable switches used in maintenance as described before. Solenoid valve 98 is energized retracting cylinder 11 and closing the clamp 13. Normally open switch 105, which senses that clamp 13 is closed, is now closed. This latches sequence relay 107 on. When right pedal 7 is again briefly energized, an automatic sequence is started. Switch 103 now energizes relay 109 through relay 107. This powers the sensor controller 110 which has a latched relay at its output 111. The normally closed (NC) contacts of 111 energize solenoid valve 97, which solenoid valve 97 drives spiral wire 38 through book perforations 39. When sensor 37 detects the end of the spiral wire 38 emerging from the left end of book 12, switch 111 is switched to open the NC contacts stopping spiral feeding and closes the normally open contacts which energize solenoid valve 96 thereby operating the cutter mechanism through cylinder 18. When the cutters have completed their cycle, normally closed sensor switch 108 is opened thereby resetting relays 107 and 109 completing the automatic cycle and resetting the appropriate pneumatic cylinders as well as sensor controller 110. Now, when left pedal 6 is briefly pressed, relay 106 is reset by opening switch 104 thereby de-energizing solenoid valve 98 which extends cylinder 11 thereby opening clamp 13 so that bound book 12 can be removed from the machine 1.

Figure 9:
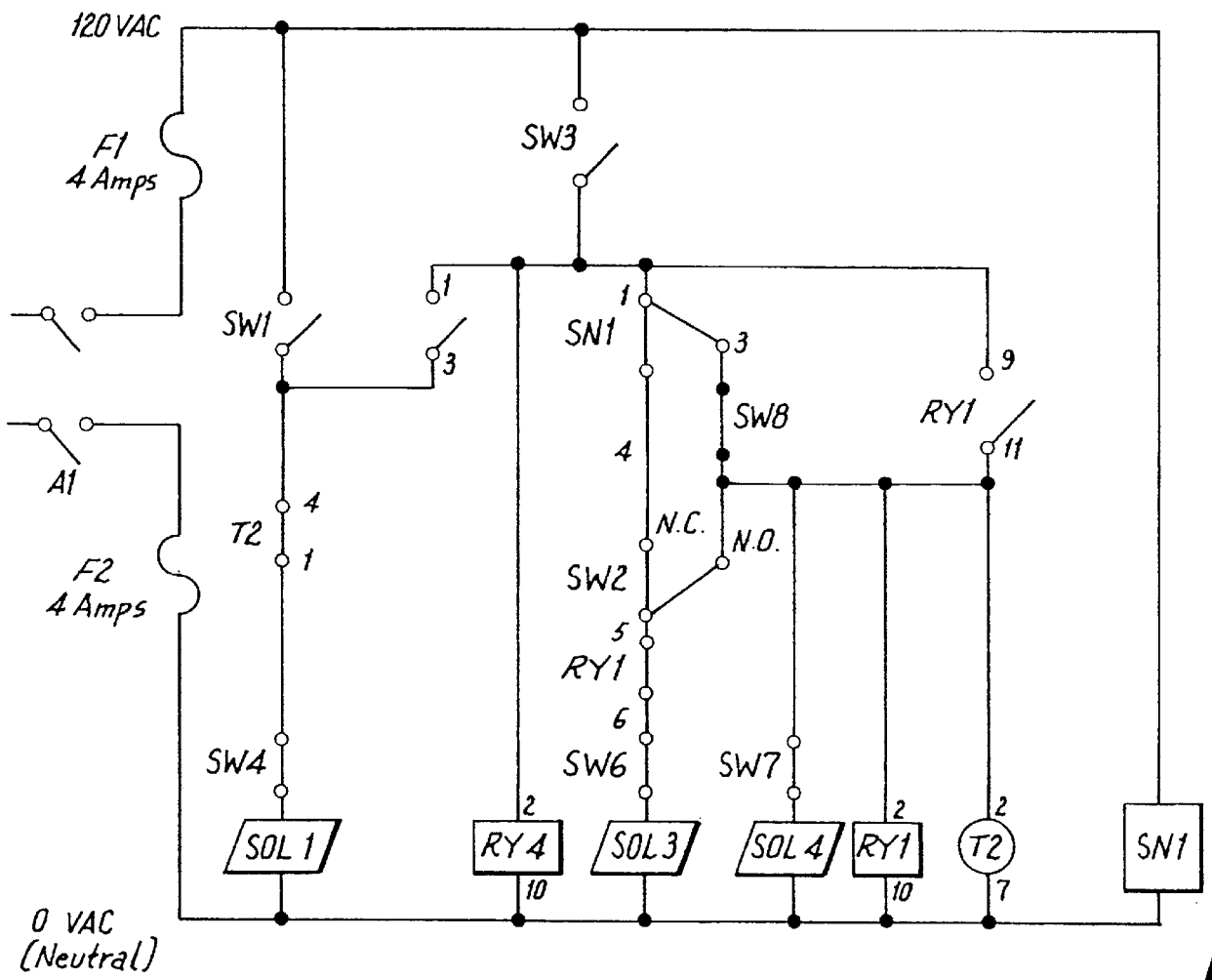
FIG. 9 is the preferred electrical schematic diagram.

FIG. 9 is an electrical schematic for the preferred embodiment. To start the machine 1, one turns on master power switch A1 at circuit line 1. 110 volts AC is supplied to the machine 1 from master power switch A1, and fuse F1 at circuit line 2. If the speed control for the spinner is turned clockwise, the spinner begins to turn.

To make a book, one first inserts a book onto the bottom supports of the clamp 13, shown in FIG. 1. One presses and holds the clamp foot pedal switch SW1 at circuit line 3, thereby activating and closing clamp 13. Through normally open contact of clamp foot pedal switch SW1, normally closed contact of relay RY2, and normally open contact of disable switch SW4, power is provided to clamp solenoid SOL1 at circuit line 3.

Thereafter, the clamp 13 closes. The closing of clamp 13 triggers microswitch SW3 at circuit line 6. Through normally open contact of microswitch SW3, clamp hold relay RY4 is powered at circuit line 5. Normally open contact of clamp hold relay RY4 1–3 closes at circuit line 4. Through microswitch SW3, normally open contact of clamp hold relay RY4, normally closed contact of knife cutter duration timer T2, and normally open contact of disable switch SW4, power is provided to clamp solenoid SOL1. The clamp 13 is then held closed.

Through normally open contact of microswitch SW3, normally closed contact of wire sensor SN1 at circuit line 7, and the normally closed contact of knife cutter foot pedal switch SW2, power is provided to spinner solenoid SOL3. The spinner closes on the spiral wire and begins to feed the spiral wire.

For automatic operation, the spiral wire reaches wire sensor SN1. Normally closed contacts of wire sensor SN1, at circuit line 7, shift to circuit line 8, providing power through microswitch SW3, wire sensor SN1, disable switch SW8, and normally open contact of disable switch SW7 at circuit line 9 to knife solenoid SOL4. The knives cutters 23, 24 come down. In addition, power is provided to knife cutter hold relay RY1 at circuit line 10 and knife cutter duration timer T2 at circuit line 11. Through normally open contact gate closed microswitch SW3 at circuit line 6, and normally opened contact of knife cutter hold relay RY1 at circuit line 11, knife hold relay RY1 and knife duration timer T2 are held on.

For manual operation, the knife cutter foot pedal switch SW2 is pressed. Normally closed contacts of knife cutter foot pedal switch SW2, at circuit line 7 shift to normally open at circuit line 8, providing power through microswitch SW3, wire sensor SN1, knife cutter foot pedal switch SW2, and normally open contact of disable switch SW7 at circuit line 9, to knife cutter solenoid SOL4. The knife cutters 23, 24 then come down. In addition, power is provided to knife cutter hold relay RY1 at circuit line 10 and knife cutter duration timer T2 at circuit line 11. Through normally open contact microswitch SW3 at circuit line 6, and normally open contact of knife cutter hold relay RY1 at circuit line 11, knife cutter hold relay RY1 and knife cutter duration timer T2 are held on.

After the delay time set at knife cutter duration timer T2, the timer T2 operates. The opening of the normally closed contact of knife cutter duration timer T2 at circuit line 3 removes power from clamp solenoid SOL1. The fingers retract and clamp 13 opens. Microswitch SW3 is released. Spiral machine 1 is now ready for the next book.

In an alternate embodiment, two features have been added to improve the reliability of the automatic feeding of the plastic binding spiral by the machine of this invention.

When using plastic coil spiral binding, the holes in the book pages and covers must have a larger diameter than those used for metal wire spiral binding to accommodate the plastic coil material which has a larger crossection. FIG. 10 shows a detail of these holes 39 on a book 12. The bridge distance B between holes 39 is fixed and matches the pitch of the binding coil to be used. However, it is noted that the distances E to the edge of the book from the holes 39 at either end are larger than the bridge distance B to resist breakout. When starting the feeding operation by hand, it was an easy matter to spread the first coil of spiral 38 to properly engage the first hold 39 in book 12. Similarly, at the distal end, the spiral was stopped short or spread by hand to prevent the spiral 38 end from hitting the end of the book since the edge is farther away than the normal spiral 38 pitch.

To improve the reliability of the automatic feeding of spiral 38 in book 12 at the proximal and distal ends, this alternate embodiment includes two spreaders 200 as shown in FIG. 11. These are two-part metal weldments with blade 203 welded to base 201 at an oblique angle A. A mounting slot 202 permits accurate positional adjustment to match the book 12 end and the spiral 38. The front of blade 203 is ground to an edge at corner 204 which is also rounded to engage spiral 38 without damage. The contour 205 spreads a single coil of the spiral as it enters into the first edge hole 39 or as it departs the last edge hole 39 at the distal end of book 12. This action simulates the action of an operator performing the same operation manually.

Figure 12:
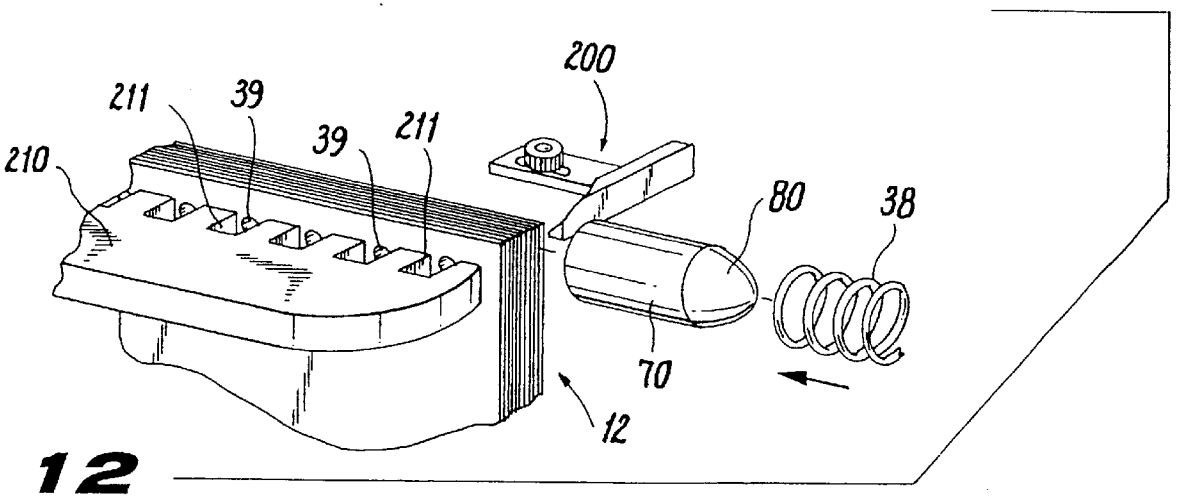
FIG. 12 is an isometric detail showing relationship between coil spreader, book clamp, and mandrel.

FIG. 12 is a detail showing the positional relationship of modified book clamp 210, mandrel 70, book 12, and proximal spreader 200. A top view detail in FIG. 13 clearly shows the position of the two spreaders 200 in position to spread a coil of spiral 38 to guide it past the book 12 edges at either side.

Figure 13:
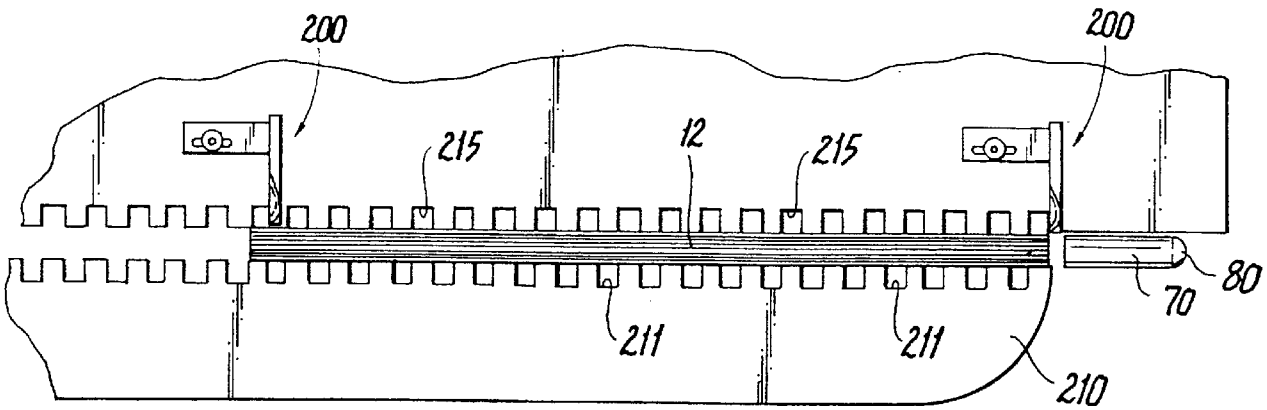
FIG. 13 is a top view detail showing both coil spreaders.

Another feature shown in FIGS. 12 and 13 are the guide notches used along the plastic spiral path 38 as it progresses through holes 39 in book 12. The edge of clamp 210 which lies against book 12 has deep notches 211 which line up with holes 39. The bearing surface on the other side of the book (which is part of the stationary top of the binding machine) also has notches 215 which are slightly offset from notches 211 (top view) to position and accurately guide spiral 38 into holes 39 of book 12.

Although not absolutely necessary, these notches 211 and 215 help to prevent occasional jamming of spiral 38 especially if the pitch of the spiral is slightly distorted.

Figure 14:
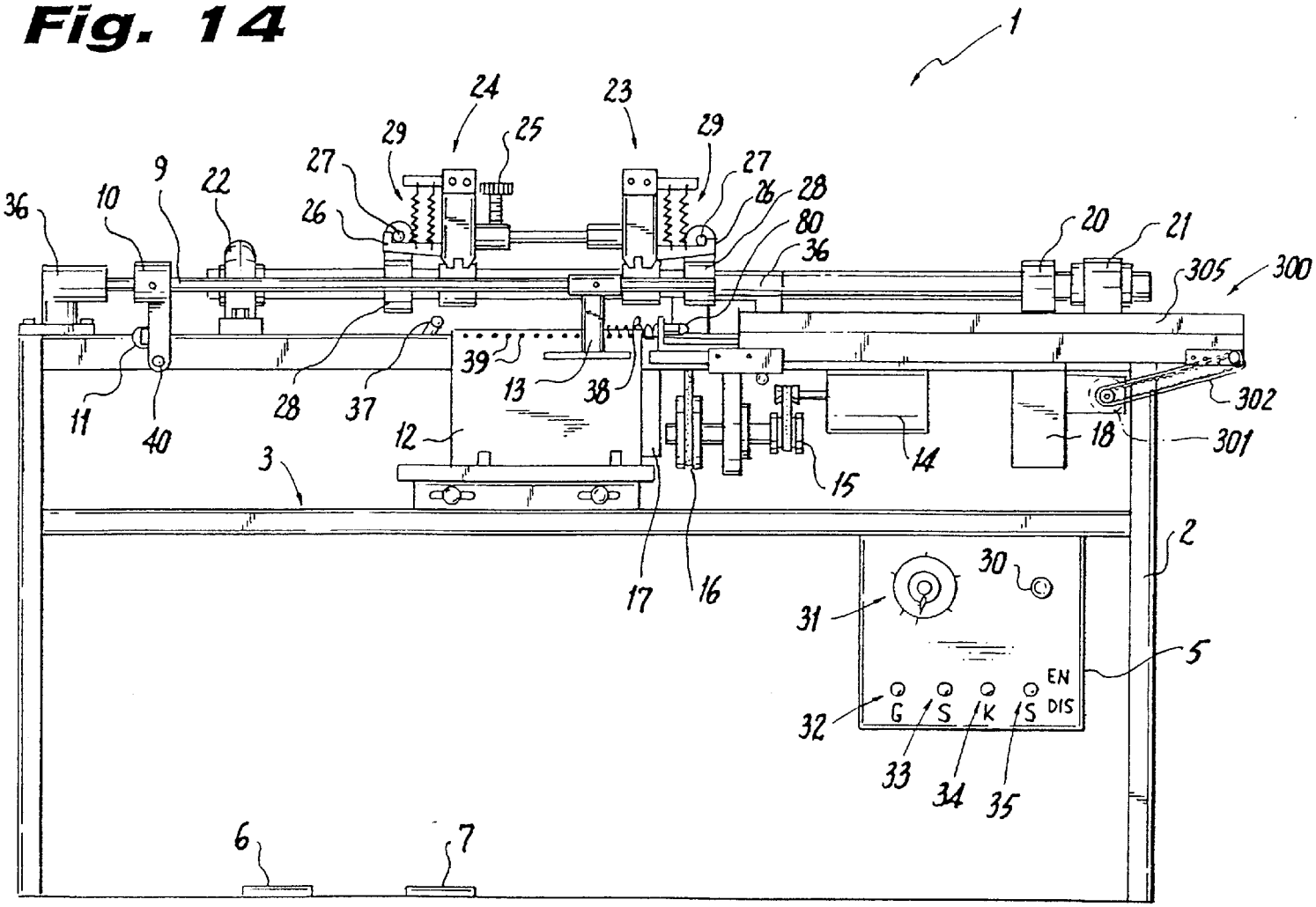
FIG. 14 is a front elevational view of the binding machine showing an alternate embodiment with a spiral feeding conveyor.

Furthermore, as shown in FIGS. 14, 15 and 15A, an advancement means, such as a conveyor 300, accurately transports the plastic spiral coil 38 to the mandrel 70 for its proper position for insertion into the first spiral insertion hole 39 of the book 12.

FIGS. 15 and 15A show details of the conveyor subsystem 300. Plate 307 attaches conveyor motor 301 (a stepper or gear motor) to the frame of the binding machine. Timing belt 302 powers conveyor drive pulley 303. Spiral 38 is supported and transported by the conveyor belt consisting of a pair of parallel elastic cables 306 which cradle spiral 38. Straight upwardly extending wall 304 and sloping upwardly extending wall 305 facilitate loading of spiral 38 lengths onto conveyor belt members 306.

Similar to the aforementioned spreader embodiment shown in FIGS. 12 and 13, in order to better provide a spiral bound book which prevents ripping at the edge of the book, the gap of the book's cover from the edge of the book to the first spiral coil insertion hole of the book is maximized by an alternate embodiment for a spreader system.

For example, as shown in FIGS. 16, 17, 18, 19 and 20, this is accomplished by the alternate spreader system which also increases the gap between adjacent coil segments to match the preferred gap from the edge of the book to the first hole, so that the plastic spiral coil can be accurately inserted into the first spiral insertion hole of the book, and thereafter into the remaining holes 39 for the book 12.

For example, while sizes of holes 39 in the book 12 may vary, the holes 39 are typically 11/64 inch in diameter, and the space between the mid point of each hole 39 to the next adjacent midpoint of the next adjacent hole 39 is about ¼ inch. Therefore the distance between adjacent holes 39 is equal to 5/64 inch, that being the distance of ¼ (or 16/64) inch from hole mid point to hole midpoint, minus the 11/64 width of each hole 39.

Normally, in the past the gap between the first hole 39 and the leading edge of the pages of the book 12 has also been only about 5/64 inch, which is too small a gap to prevent ripping of the cover of the book 12 at that point.

It therefore beneficial to increase the gap to about 3/16 inch, which is more than twice the size of the typical gap on the leading edge of a conventional spiral bound book.

However to increase the leading edge gap, the distance between adjacent coil segments of a plastic spiral coil 38 must be increased from the typical 5/64 inch length to 3/16 inch.

This distance is provided by a spreader mechanism which engages the coil as it advances from an alignment mandrel 70 to the position where it is inserted into the leading hole 39 of the book 12 to be bound. The leading spreader pushes apart the first adjacent coil segments from their hole engaging distance of 5/64 inch to the increased distance of 3/16 inch.

Figure 19:
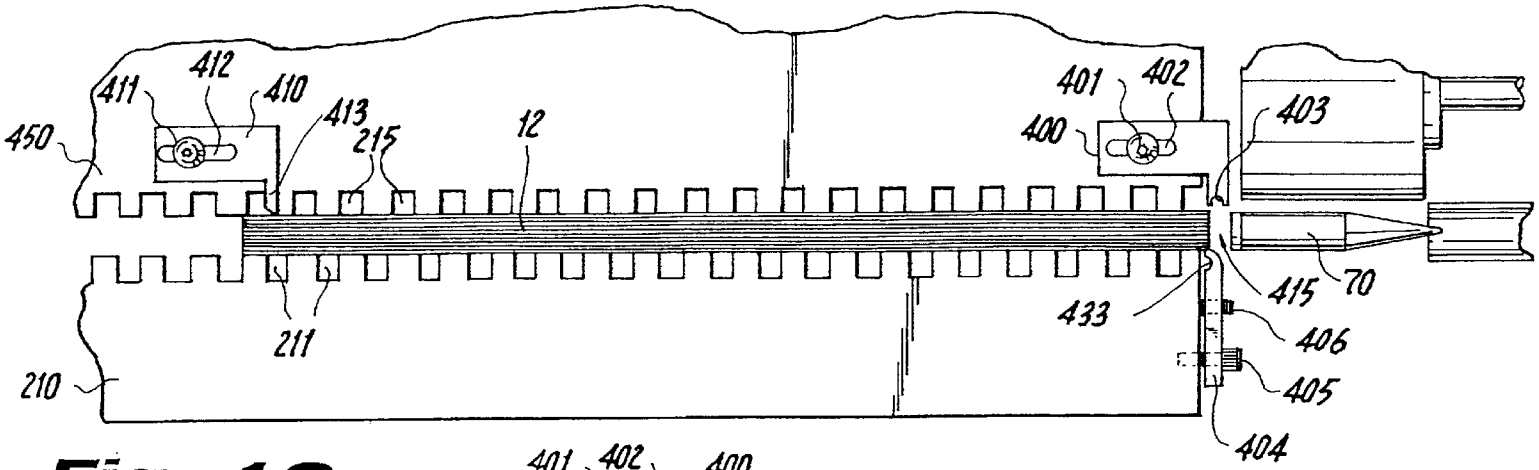
FIG. 19 is a top plan view of the three spreader parts of the alternate embodiment shown in FIGS. 16, 17 and 18, shown as mounted on the binding machine.
Figure 20:
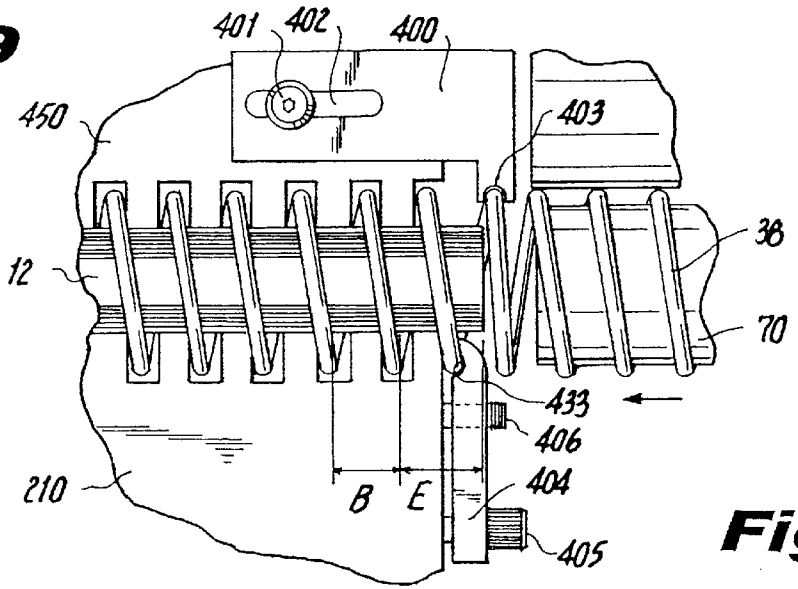
FIG. 20 is a top plan view detail of the placement of the two front spreader parts shown in FIG. 19, shown with a spiral coil.

In this alternate spreader system, as shown in FIGS. 17, 19 and 20, one of the leading edge spreader parts 400 is mounted to the top surface of the rear fixed comb clamp member 450 with screw 401 in slotted adjustment hole 402. This adjustment is for increasing or decreasing the position of the spreader (see gap 415 in FIG. 19) with respect to the edge of the book 12 to be closed with the spiral coil 38. A coil engaging guide slot 403 with arcuate convex edge 420 is at the distal end of an extension arm of spreader part 400.

The side front spreader part 404 is shown in FIGS. 18, 19 and 20. It is mounted to the side of the movable comb clamp jaw 210 with screw 405 in slotted adjustment hole 431. Further features include rounded tip 430, threaded set screw hole 432 and spiral guidance groove 433 on the back edge. The slotted adjustment allows for alignment to match the end of book 12 and spiral 38. As shown in FIG. 20, groove 433 engages a single coil of spiral 38, and set screw 406 adjusts the gap with the edge of jaw 210 so as to accommodate a variety of crossectional diameters of different types of spiral 38.

As shown in FIGS. 16 and 19, a trailing spreader guide 410 is provided at the trailing end of the book 12 to spread apart arcuate segments of the spiral coil 38 as it departs the last edge hole 39 at the trailing distal end of book 12. Trailing guide spreader 410 includes mounting screw 411 and slot 412 for positional adjustment of spreader 410 and beveled extension 413 having contoured end 425 to engage the spiral coils of spiral coil 38 as it engages the last trailing hole 39 of book 12. The spreaders 400 and 404 act in concert to spread a single coil of the spiral coil 38 as it enters into the first edge hole 39. Spreaders 400 and 404 are positioned a distance 415 extending therefrom to the trailing end of mandrel 70 guiding spiral coil 38 toward book 12.

FIG. 19 is a top plan detail view showing the positional relationship of modified book clamp 210, mandrel 70, book 12, and spreaders 400, 404 and 410 in position to spread a coil of spiral 38 to guide it past the book 12 edges at either side.

As similar to FIGS. 12 and 13 with respect to the embodiment using spreader 200, FIG. 19 also shows the guide notches 211 of combed clamp jaws 210 and 450 used along the path of plastic spiral 38 as it progresses through holes 39 in book 12. Notches 211 also line up with holes 39. The bearing surface on the other side of the book forming the fixed comb clamp jaw 450 (which is part of the stationary top shelf 4 of the binding machine 1) also has notches 215 which are slightly offset from notches 211 (top view) to position and accurately guide spiral 38 into holes 39 of book 12. Notches 211 and 215 prevent occasional jamming of spiral 38 as it is transported through holes 39 of book 12.

Figure 21:
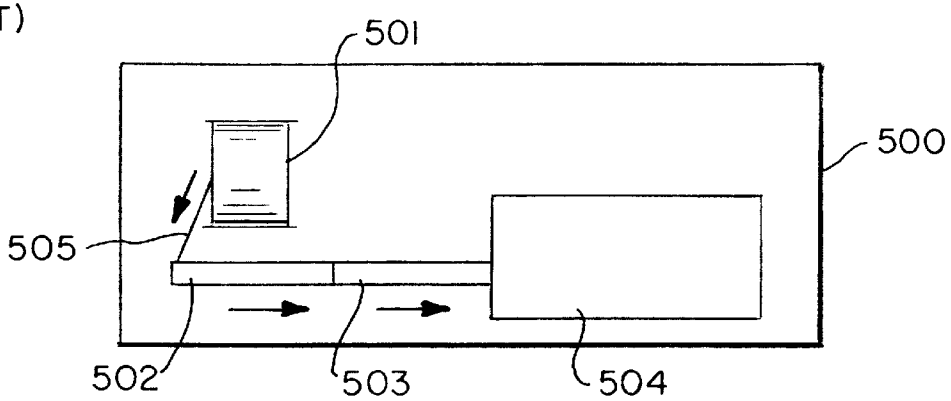
FIG. 21 (PRIOR ART)
FIG. 21 is a schematic representation of a prior art integrated coil forming and binding machine.

FIG. 21 shows a prior art machine by Pfaffle (U.S. Pat. No. 4,429,278) which integrated the process of the forming of plastic spiral binding coils from plastic thread with that of a binding machine to produce an end product of spiral bound books. The process machine 500 depicted in FIG. 21 involves pulling plastic thread 505 from spool 501, preheating it, winding around a mandrel in a heated zone 502, continuously feeding this hot coil into a cooling sleeve 503 for rapid cooling using a blast of cold air generated by a vortex cooler and then feeding the resulting spiral into the binding machine 504.

Unfortunately, this tightly coupled process has a drawback. The plastic coil material of polyvinyl-chloride (PVC) gets embrittled by the rapid cooling. It develops voids largely manifested as a hollow core in its interior crossection. The resulting material is too brittle to process in binding machine 504, as the ends are frequently broken off during the bending process or in early use of the bound books by the consumer.

Figure 22:
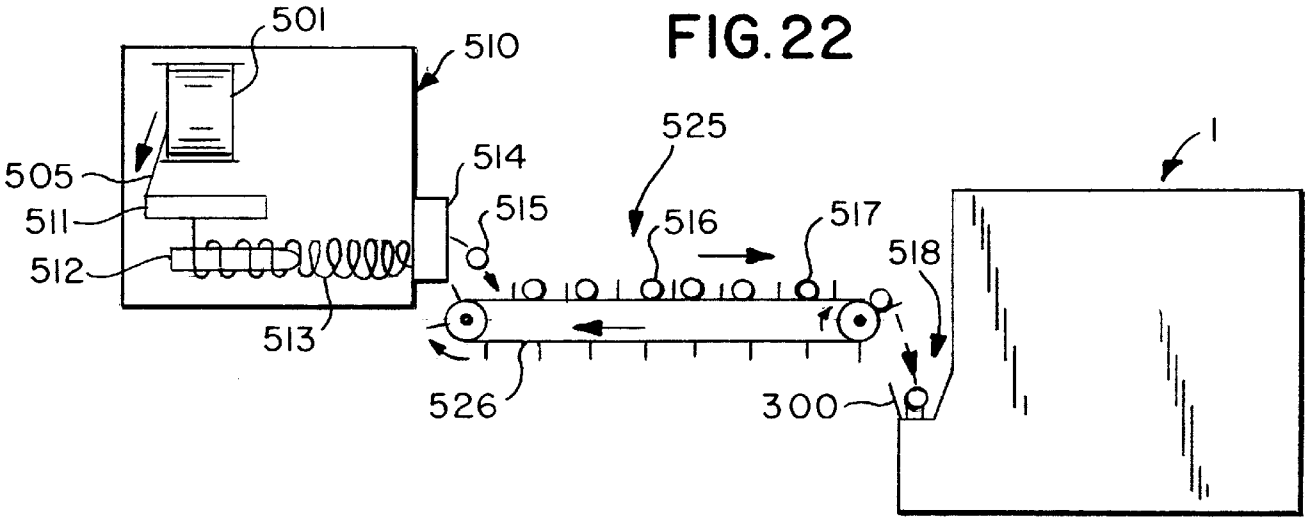
FIG. 22 is a schematic representation of an embodiment of a linkage cooling conveyor utilized with this invention.

Since it is still desirable to integrate the process of forming spirals from plastic thread at the same site as the binding machine in a semi-continuous process, the linkage conveyor 525 of the present invention shown schematically in FIG. 22 has been developed. Since spirals of a variety of gauges and diameters are used in the binding process, storage of these various sizes and waste due to the length of the spirals not being optimal for a given size book would be eliminated if the processes were linked. However, this would have to be accomplished in such a manner as to permit slow cooling of the spirals between the manufacturing step and the use step in a binding machine.

Semi-automated binding machines 1 interact with small plastic spiral forming machines 510, which operate at a compatible speed to machines 1.

For example, a typical forming machine 510 takes plastic thread 505 from spool 501, preheats it in chamber 511 and then winds it on a mandrel 512 where it emerges in free air as a hot spiral coil 513. It passes through a guillotine cutter 514 which cuts it to size.

The hot, but rigid, plastic spiral coil 515 emerges from the cutter (shown in end view for clarity).

In normal prior art use, these long cut spiral coils would fall into a bin for packaging or storage.

In the present application, still-hot plastic spiral coils 515 are cut to the length required for the particular book being bound.

Then the plastic coils fall into a narrow compartment formed by adjacent vanes 527 attached to a conveyor belt 526. Cooling conveyor 525 moves intermittently to index to the next empty compartment every time a segment of coil 515 is cut. As it takes some time for the cooling conveyor 525 to advance, a coil 515 in the midsection 516 would be significantly cooler by action of ambient air. Further movement in ambient air temperature near the end of travel further cools coil 517. At the end of travel, coils 518 drop into the receiving conveyor 300 (or input through) of binding machine 1 at a temperature (close to room temperature) which is ideal for processing. There is no material embrittlement since slow cooling using ambient air is used.

Figure 23:
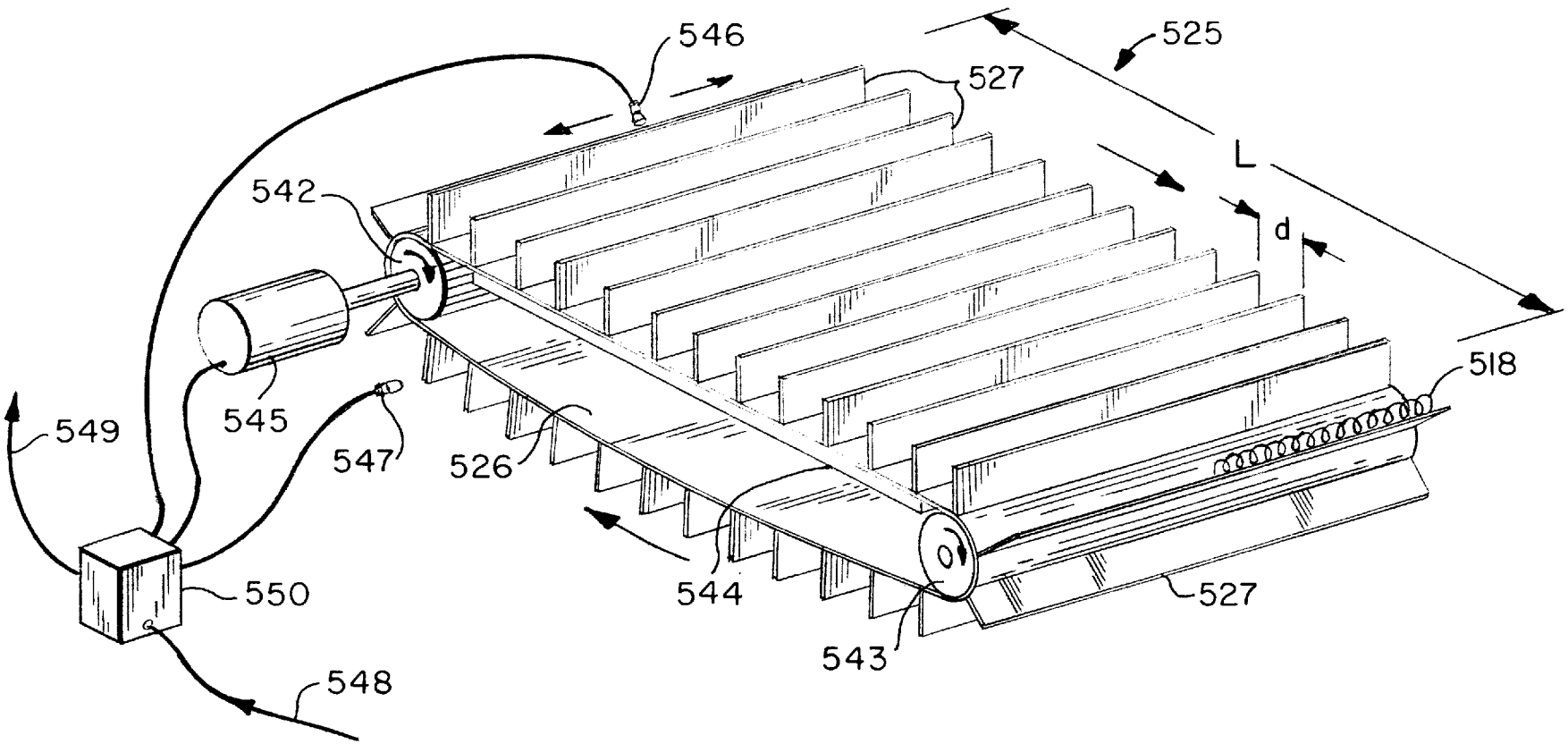
FIG. 23 is an isometric view of operating parts of the linkage cooling conveyor.

While FIG. 22 shows the movement of coils by cooling conveyor 525 at ambient air temperature, other cooling methods known to those skilled in the art may be used to cool coils 515 while coils 515 advance toward receiving conveyor 300, such as by exposure of the coils 517 to pressurized blasts of compressed air, by exposure to coils 518 to conventional cooling chambers cooled by freon filled conduits or othe refrigeration means. FIG. 23 shows the essential working parts of linkage cooling conveyor 525. Wide belt 526 has a central section of timing belt construction which engages drive pulley 542 driven by DC gearmotor 545. A stationary horizontal platen 544 supports belt 526 which has a rigid plastic chain construction with attached fins 527 creating compartments which hold one length of plastic spiral binding coil. Front pulley 543 spaces belt 526 at length L. A motor controller 550 controls motor speed and also intermittent on/off cycle points as dictated by spiral length sensor (typically photovoltaic) and "next vane" position sensor 547. Lead 549 controls the quick cutting cycle of the spiral cutter 514 shown in FIG. 22, while lead 548 communicates with a Dimension "d" is selected to accommodate the largest diameter spiral of interest with some play while length L is selected to provide enough cooling time for the largest diameter and gauge plastic spiral coil to adequately cool in the highest design temperature ambient air environment.

Figure 24:
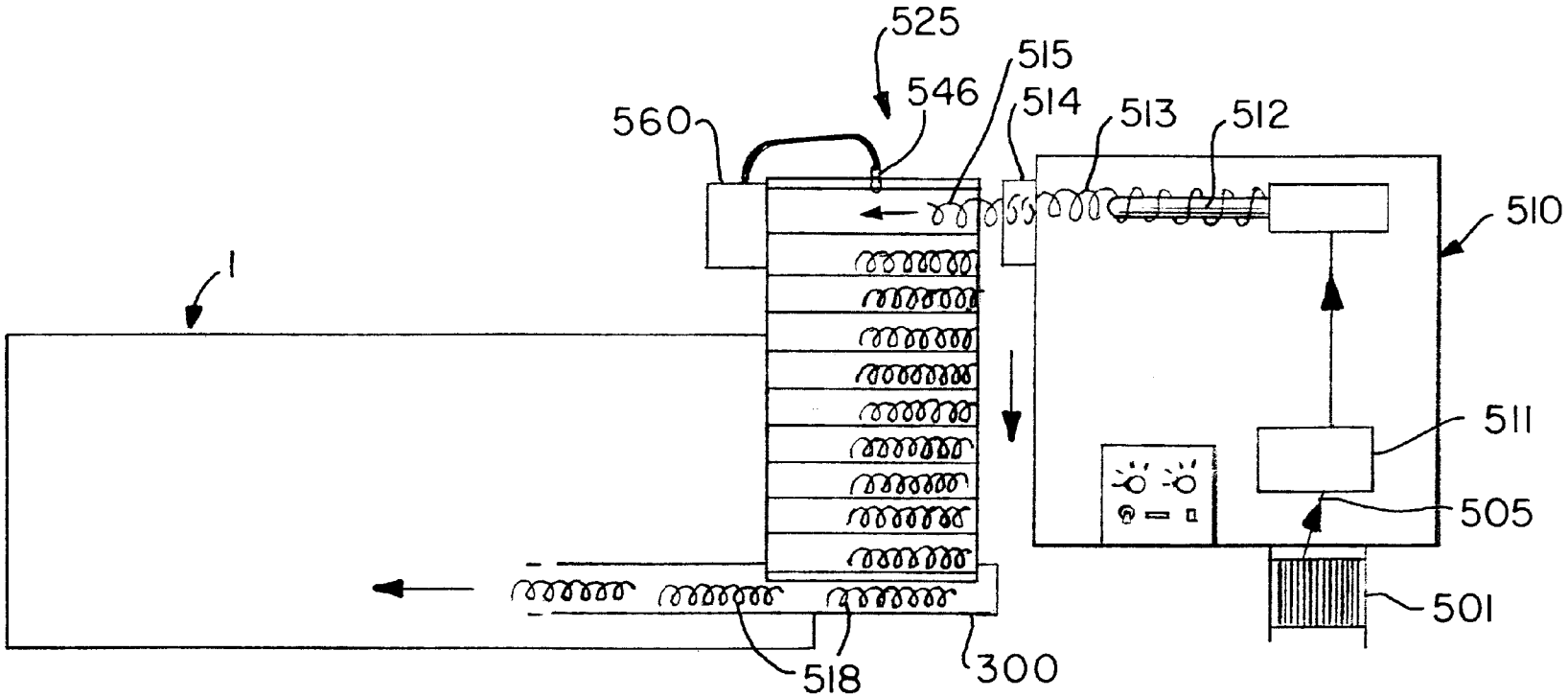
FIG. 24 is a top plan view of the linkage cooling conveyor with representations of the spiral coil forming portion and the coil binding portion of the present invention.
Figure 25:
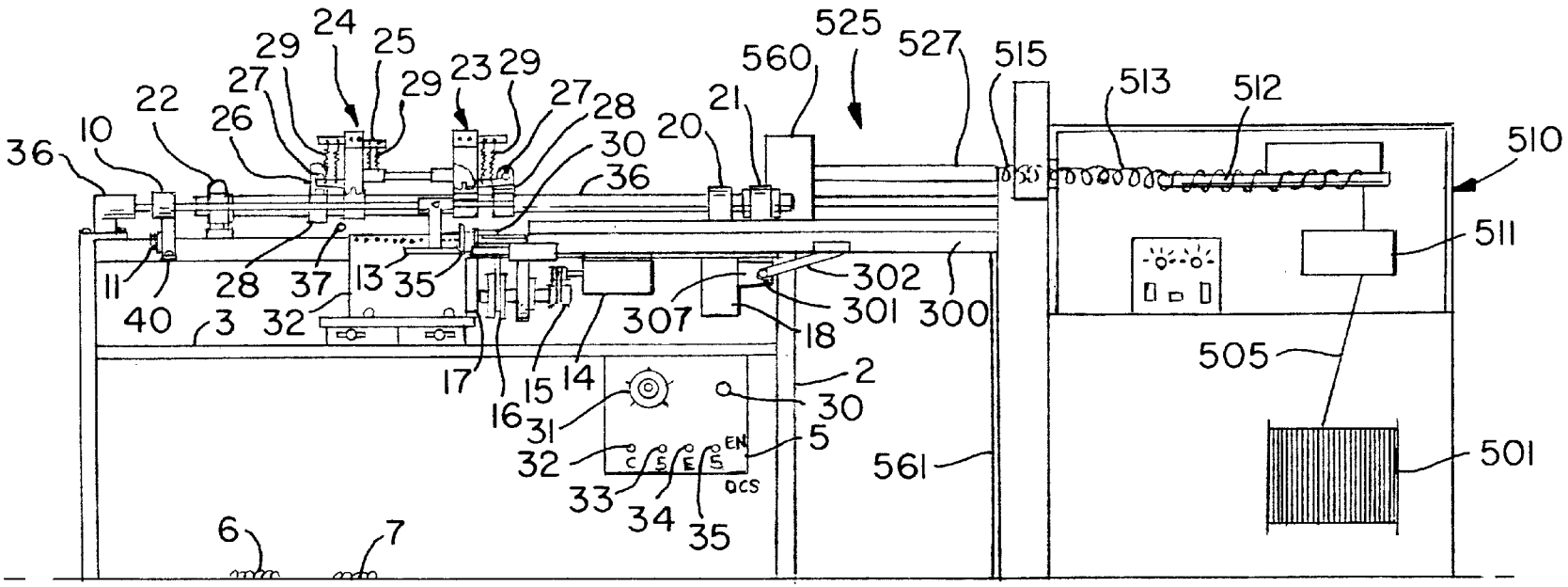
FIG. 25 is a front elevation view of the linkage cooling conveyor connecting the spiral coil forming portion and the coil binding portion thereof.
Figure 26:
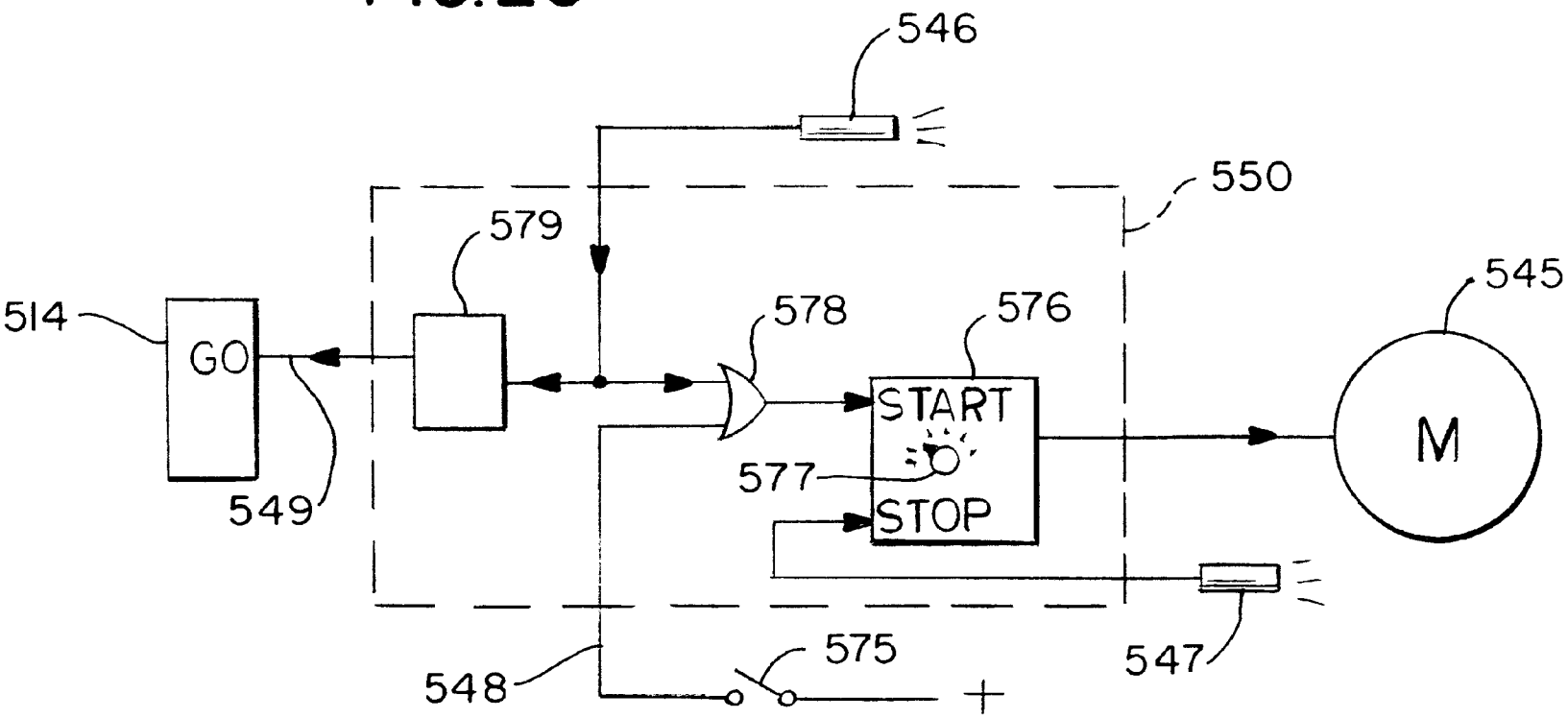
FIG. 26 is an electrical block diagram of the linkage cooling conveyor thereof.

FIG. 24 is a top view of the coupled machine portions 1 and 510. FIG. 25 is a front view thereof. FIG. 26 is an electrical block diagram of the linkage cooling conveyor 525. Housing 550 contains the drive motor 545 and its controller 576 and other electrical components. Sensor 546 detects the end of the plastic spiral. Sensor 546 is adjusted to the required spiral length as dictated by the book being bound prior to the start of the run. It initiates the cutting of hot spiral 515 by cutter 514 by a signal amplified by driver 579. This signal pulse from sensor 546 also initiates an index cycle of motor 545 through controller 576 and "OR" logic gate 578. Motor 545 is stopped when the next vane is detected in the proper position by photo detector 547, also through controller 576. Controller 576 is also adjusted manually during initial set-up to a motor speed for adequate index speed (to keep up with coil machine 510) with a minimum of over-shoot. Near the end of the production run, coil forming machine 510 is turned off (it normally runs continuously) while linkage cooling conveyor 525 is full of plastic spiral coils 515,516,517. Momentary push button single pole single throw (SPST) 575 is used to index linkage cooling conveyor 525 one step manually each push to empty the compartments formed by fins 527 of linkage cooling conveyor 525, as needed. This signal is coupled through line 548 and the other input of "OR" gate 578. Leg 561 in FIG. 25 is used to support the front end of linkage cooling conveyor 525 and to help position it accurately over an extended input conveyor 300 which is part of binding machine 1.

While a DC gearmotor is illustrated in these drawings, other motors such as AC gearmotors or stepping motors can be used as well. If a stepping motor is used, "next vane" sensor 547 is not required since synchronism can be maintained by simply stepping off the required number of steps once the start signal is encountered, (This is an "open-loop" as opposed to a "closed-loop" control system).

It is also known that other modifications may be made to the present invention, without departing from the score of the invention, as noted in the appended claims.

I claim:

1. A combination in line plastic spiral coil forming and binding machine comprising:

a coil forming machine for heating, forming and cutting discrete segments of hot binding coils at a first higher temperature, said discrete segments being of a length required for a particular book being bound;

a binding machine for binding said discrete segments into holes of the book being bound; and means for carrying said segments of hot binding coils from said coil forming machine to said binding machine under conditions in ambient air, said carrying means providing sufficient duration of travel time to provide enough slow cooling time in said ambient air to bring the temperature of said binding coils down to close to room temperature and a solid, non-brittle state.

2. The combination of claim 1 in which said carrying means is a conveyor.

3. The combination of claim 2 in which said carrying means relies on natural convection to cool said segments of binding coils.

4. The combination of claim 3 in which said conveyor has means to carry said binding coils such that said segments of binding coils are parallel to and spaced from each other on said conveyor.

5. The combination of claim 4 in which said conveyor has vanes separating said segments of binding coils.

6. A combination in line plastic spiral coil forming and binding machine comprising:

a coil forming machine for heating, forming and cutting discrete segments of hot binding coils at a first higher temperature, said discrete segments being of a length required for a particular book being bound;

a binding machine for binding said discrete segments into holes of the book being bound;

a means for carrying said segments of hot binding coils from said coil forming machine to said binding machine; and said carrying means cooling said segments of hot binding coils on said carrying means to bring the temperature of said binding coils down to about room temperature at a rate of cooling to produce a solid, non-brittle state of said binding coils under conditions in ambient air, said carrying means providing sufficient duration of travel time to provide enough slow cooling time in said ambient air to bring the temperature of said binding coils down to close to room temperature and said solid, non-brittle state.

7. The method of binding a book having openings for binding comprising the steps of:

heating, forming and subsequently cutting discrete segments of hot binding coils at a first higher temperature, said discrete segments being of a length required for a particular book being bound;

conveying said segments of hot binding coils on a conveyor to a book binding machine;

cooling said hot binding coils while being conveyed on said conveyor to said book binding machine, to bring the temperature of said binding coils down to about room temperature at a rate of cooling to produce a solid, non-brittle state of said binding coils; and binding said book in said binding machine.

* * * * *